US011311443B2

(12) United States Patent
Davis et al.

(10) Patent No.: US 11,311,443 B2
(45) Date of Patent: Apr. 26, 2022

(54) CASKET ASSEMBLY METHOD

(71) Applicant: Vandor Corporation, Richmond, IN (US)

(72) Inventors: Gerald H. Davis, Fountain City, IN (US); Gary L. Cox, Richmond, IN (US)

(73) Assignee: Vandor Group, Inc., Richmond, IN (US)

( * ) Notice: Subject to any disclaimer, the term of this patent is extended or adjusted under 35 U.S.C. 154(b) by 0 days.

(21) Appl. No.: 17/002,554

(22) Filed: Aug. 25, 2020

(65) Prior Publication Data

US 2020/0383860 A1 Dec. 10, 2020

Related U.S. Application Data

(63) Continuation of application No. 16/557,737, filed on Aug. 30, 2019, now Pat. No. 10,751,242, which is a continuation of application No. 15/417,197, filed on Jan. 26, 2017, now Pat. No. 10,398,616.

(60) Provisional application No. 62/287,169, filed on Jan. 26, 2016.

(51) Int. Cl.

| | |
|---|---|
| ***A61G 17/04*** | (2006.01) |
| ***A61G 17/00*** | (2006.01) |
| ***A61G 17/007*** | (2006.01) |
| ***A61G 17/02*** | (2006.01) |

(52) U.S. Cl.

CPC ..... *A61G 17/044* (2016.11); *A61G 17/004* (2016.11); *A61G 17/0073* (2013.01); *A61G 17/034* (2017.05); *A61G 17/041* (2016.11)

(58) Field of Classification Search

CPC .. A61G 17/044; A61G 17/041; A61G 17/004; A61G 17/034; A61G 17/0073; B31B 50/26; B65D 5/32; B65D 5/324

USPC ..... 27/2, 4; 493/162; 229/122.21, 122.3

See application file for complete search history.

(56) References Cited

U.S. PATENT DOCUMENTS

| | | | | |
|---|---|---|---|---|
| 647,959 | A | 4/1900 | Gerwe | |
| 768,481 | A * | 8/1904 | Post | A61G 17/0073 27/2 |
| 1,661,377 | A | 3/1928 | Lutz | |
| 1,840,675 | A | 1/1932 | Letzig | |
| 2,230,433 | A | 2/1941 | Pinto | |
| 2,238,774 | A | 4/1941 | Hopkes | |
| 2,636,246 | A | 4/1953 | Quaka | |
| 2,735,157 | A | 2/1956 | Hotchkiss et al. | |
| 4,063,337 | A * | 12/1977 | Havey, III | A61G 17/001 27/2 |
| 4,123,831 | A | 11/1978 | Covington | |
| 4,156,956 | A | 6/1979 | Partridge | |
| 4,253,206 | A | 3/1981 | Cherry | |

(Continued)

*Primary Examiner* — William L Miller

(74) *Attorney, Agent, or Firm* — Maginot, Moore & Beck LLP

(57) ABSTRACT

A method of assembling a casket assembly includes folding a left end of one side panel toward a main body portion to form part of a head end of the casket assembly. The method also includes folding a right end of the side panel toward the main body portion to form part of a foot end of the casket assembly. Another side panel is folded the same way, and also forms part of both the head end and the foot end. The method includes arranging the first side panel and the second side panel within a base of the casket assembly, and removably coupling a lid of the casket assembly to the side panels.

17 Claims, 18 Drawing Sheets

(56) References Cited

U.S. PATENT DOCUMENTS

| | | | | |
|---|---|---|---|---|
| 4,305,186 | A | 12/1981 | Cherry | |
| 4,993,129 | A | 2/1991 | Underwood | |
| 5,231,741 | A | 8/1993 | Maguire | |
| 5,454,141 | A | 10/1995 | Ozbun | |
| 5,775,061 | A | 7/1998 | Enneking | |
| 5,815,898 | A | 10/1998 | Jenkins | |
| 5,964,014 | A * | 10/1999 | Wang | A61G 17/004 27/2 |
| 6,145,175 | A | 11/2000 | Enneking | |
| 6,574,840 | B1 * | 6/2003 | Doppel | A61G 17/06 27/2 |
| 7,003,855 | B2 | 2/2006 | Lew | |
| 7,204,003 | B2 | 4/2007 | Davis | |
| 8,607,423 | B2 | 12/2013 | Davis | |
| 2002/0004972 | A1 | 1/2002 | Michaud | |
| 2005/0193535 | A1 * | 9/2005 | Davis | B65D 85/62 27/2 |
| 2007/0084028 | A1 | 4/2007 | Cox | |
| 2012/0042488 | A1 * | 2/2012 | Hsu | A61G 17/0073 27/4 |
| 2014/0026378 | A1 | 1/2014 | Gessel | |
| 2014/0123450 | A1 | 5/2014 | Jenson | |
| 2014/0230203 | A1 | 8/2014 | Cox | |
| 2016/0199244 | A1 * | 7/2016 | Cox | A61G 17/0073 27/4 |
| 2017/0281448 | A1 | 10/2017 | Davis | |
| 2020/0146920 | A1 * | 5/2020 | Davis | A61G 17/0073 |

* cited by examiner

CASKET ASSEMBLY METHOD

This is a continuation of U.S. patent application Ser. No. 16/557,737, filed Aug. 30, 2019, which is a continuation of U.S. patent application Ser. No. 15/417,197, filed Jan. 26, 2017, now U.S. Pat. No. 10,398,616, which in turn claims the benefit of U.S. Provisional Patent Application Ser. No. 62/287,169, filed Jan. 26, 2016.

FIELD OF THE INVENTION

This invention relates generally to caskets, and more particularly, to lightweight caskets.

BACKGROUND

Caskets and cremation containers are constructed from a plurality of materials, including wood, metal, and paper materials, as well as combinations of the foregoing. These caskets and cremation containers vary substantially in price. While wood and metal-based caskets can be expensive, paper-based cremation containers can provide a viable low cost option when cremation is contemplated. In fact, extremely low costs may be achieved by employing a corrugated paper cremation container, which is a fraction of the cost of hardwood or metal caskets. Even if cost is not a major consideration, corrugated paper caskets are a popular choice for cremation, in part because they are completely consumed during the cremation process.

Many corrugated paper caskets can have ornamentation and other design elements that approximate decorative wood or steel caskets. Many people find such paper caskets to be suitable for presentation at a viewing and/or funerary service. These ornately designed paper caskets represent a cost savings over hardwood caskets, and are particularly advantageous in cases in which the casket is to be consumed during the cremation process.

While ornately designed paper caskets are less expensive than hardwood caskets, they still represent a significant cost that may not be practical in some cases. In such cases, a more inexpensive option is a simple rectangular corrugated paper container and associated simple rectangular lid that fits over the container in a manner similar to that of a common shoebox. The deceased fits within the container and then the rectangular lid is fitted over the container to close off the casket.

The need for such inexpensive caskets arises in situations of financial need, and also in disaster areas where many deceased are located in a relatively small area. The paper container has significant advantages over traditional caskets in this environment including the ability to transport significant numbers of the lightweight paper casket and the disposability of such caskets.

While cardboard cremation caskets are typically considered to be an economical approach the storage of the deceased, a significant cost nevertheless arises as a result of shipping costs. Even though the caskets are fairly light, they are more or less as bulky as traditional wood and metal caskets. As a result, funerary and/or cremation establishments pay a shipping premium due to the size of the cremation caskets. One way in which such costs can be reduced is to ship the container unassembled, which requires less space in shipping and storing. In such a case, the funerary or cremation establishment is required to perform the assembly of the caskets. Assembly of the caskets can be relatively complicated and time consuming, particularly if performed on an intermittent basis at a retail point of sale.

Thus, there is a need for a cremation casket that has reduced shipping costs without requiring complex assembly at the retail point of sale.

Another problem associated with cardboard containers is the cost of production of the casket relative to the cost paid by the end purchaser of the casket. Because one of the desired aspects of the cardboard containers is to provide an economical option to those paying funeral expenses, it is necessary to produce the caskets at a proportionately economical cost. Accordingly, the greater the number of pieces that must be produced, as well as the greater the number of different pieces that must be produced, increases the overall cost of production of the cardboard containers by requiring additional materials as well as additional machinery and manufacturing costs. Thus, there is a need for a cremation casket that has a reduced number of parts and different parts to reduce costs of producing the cremation casket.

Another problem associated with cardboard containers relates to the inability to raise the head and upper torso of the deceased within the cardboard container to a height which facilitates viewing of the deceased within the casket. Any mechanism used to raise the head and upper torso of the deceased must either be removable after use or must be disposable along with the cardboard container. Thus, there exists a need for a low cost alternative for raising the head and upper torso of the deceased that is removable or disposable.

SUMMARY

At least one embodiment of the present invention addresses at least some of the above identified needs by providing a casket assembly that includes a lift apparatus configured to temporarily elevate a head end of an insert that is received within the casket assembly and on which the deceased is lain within the casket assembly. In exemplary embodiments, the lift apparatus includes a panel that is hinged to allow at least two configurations. In a first configuration, the head end of the insert is spaced a first distance from the bottom of the base of the casket assembly. In a second configuration, the head end of the insert is spaced a second distance, less than the first distance, from the bottom of the base of the casket assembly.

A first embodiment includes a method of assembling a casket assembly includes folding a left end of one side panel toward a main body portion to form part of a head end of the casket assembly. The method also includes folding a right end of the side panel toward the main body portion to form part of a foot end of the casket assembly. Another side panel is folded the same way, and also forms part of both the head end and the foot end. The method includes arranging the first side panel and the second side panel within a base of the casket assembly, and removably coupling a lid of the casket assembly to the side panels.

A second embodiment is a casket assembly that includes a casket, a panel and a platform. The casket includes a head end having an inner surface and a bottom having an upper surface. The panel is coupled to the upper surface of the bottom of the casket, and includes a head portion, a bottom portion, and a plurality of hinges arranged between the head portion and the bottom portion. The platform is supported by the panel and is received within the casket. The panel is movable between a first configuration, wherein a first end of the platform is spaced a first distance from the bottom of the casket, and a second configuration, wherein the first end of the platform is spaced a second distance from the bottom of the casket. The first distance is greater than the second distance.

In some embodiments, an elongated element fixedly coupled to the head portion of the panel such that pulling the elongated element in a direction away from the bottom of the casket causes the head portion of the panel to slide from the first position to the second position.

DETAILED DESCRIPTION

Figure 1A:
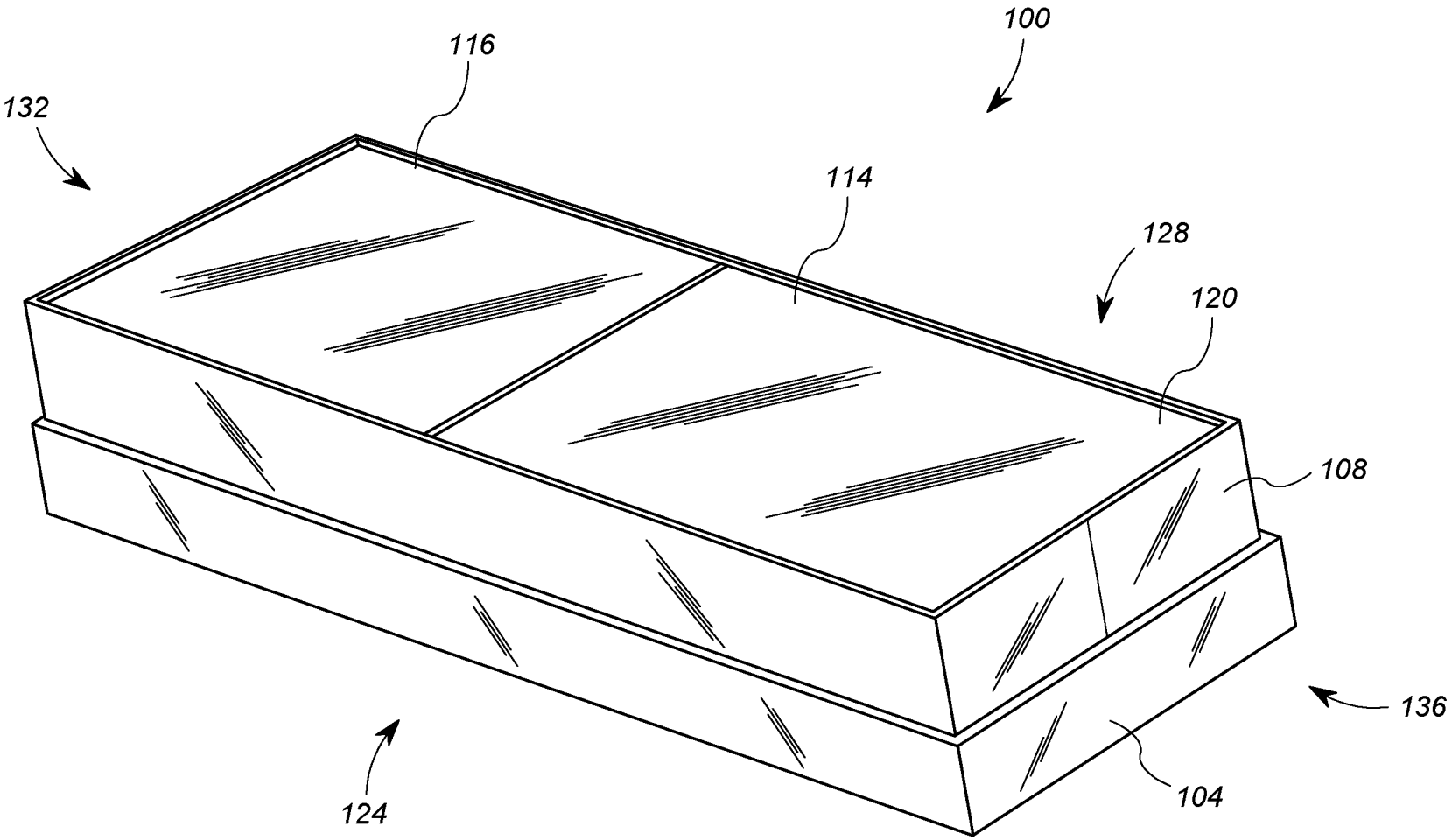
FIG. 1A depicts a top, front perspective view of a casket assembly including a base, two side panels, a head lid portion, and a foot lid portion.
Figure 1B:
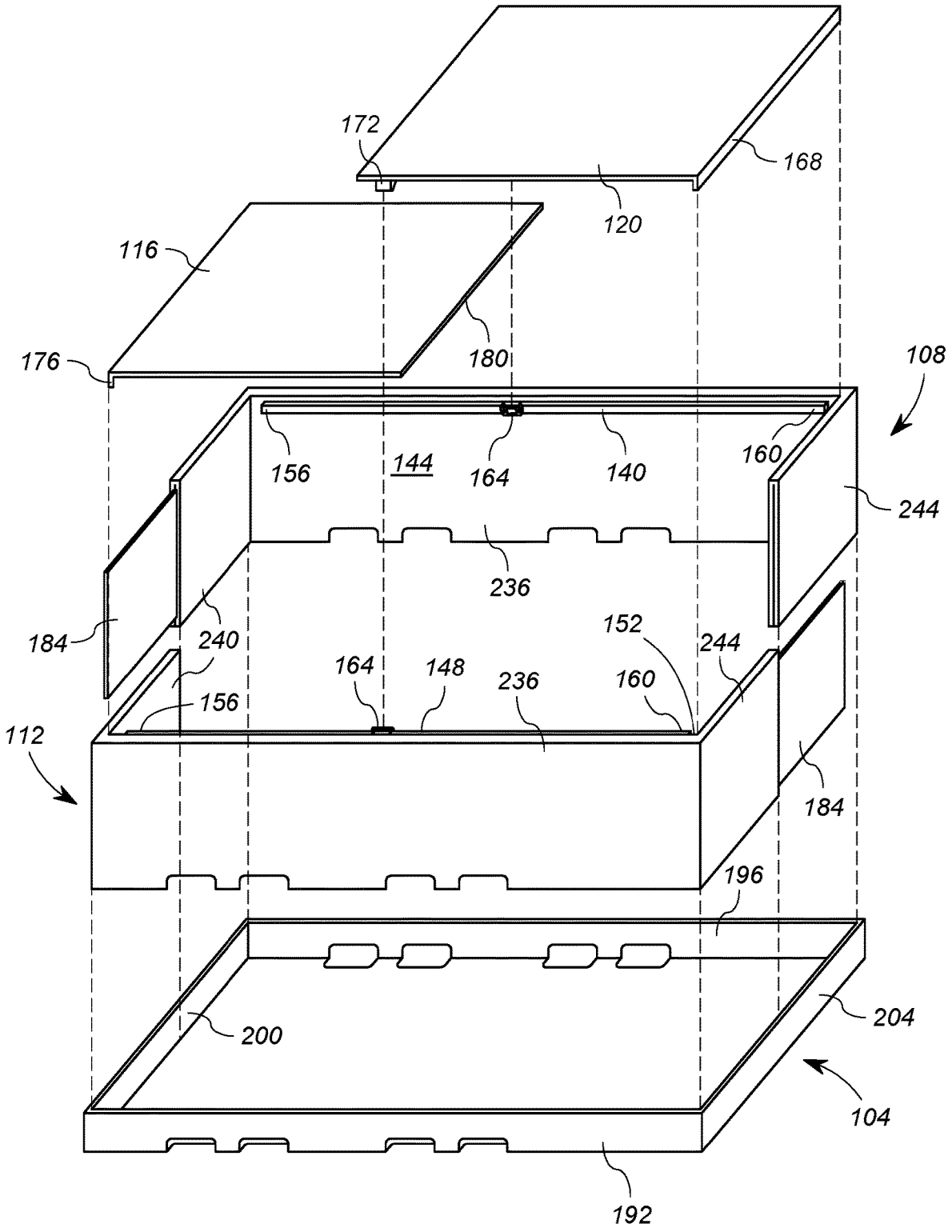
FIG. 1B depicts an exploded perspective view of the casket assembly of FIG. 1A.

As shown in FIGS. 1A and 1B, a casket assembly 100 includes a base 104, a first side panel 108, a second side panel 112, and a lid 114 made up of a head lid portion 116 and a foot lid portion 120. In general, the casket assembly 100 is configured to receive and reasonably fit the dimensions of a human deceased laying flat. As shown in FIG. 1A, the first side panel 108 and the second side panel 112 are configured to be partially received within the base 104 such that the base 104, the first side panel 108, and the second side panel 112 together make up a first side 124, a second side 128, a head end 132, and a foot end 136 of the casket assembly 100. More specifically, when partially received in the base 104, the first side panel 108 makes up a portion of the head end 132, a portion of the second side 128, and a portion of the foot end 136 of the casket assembly 100, and the second side panel 112 makes up a portion of the head end 132, a portion of the first side 124, and a portion of the foot end 136 of the casket assembly 100.

As described in more detail below, the first and second side panels 108, 112 of the casket assembly 100 are originally formed identically to one another, to facilitate ease of manufacturing. The first and second side panels 108, 112 can be formed of, for example, a corrugated paper material, and can be formed by, for example, die cutting. After being formed identically to one another, the first and second side panels 108, 112 are folded from a flat or unfolded configuration to a folded configuration (shown in FIGS. 1A and 1B), in such a way as to mirror one another such that, together, they make up the first side 124, the second side 128, the head end 132, and the foot end 136 of the casket assembly 100. It is understood that the first and second side panels 108, 112 are identical and formed opposite to one another and, thus, the description of each of the side panels 108, 112 applies to either of them interchangeably. In other words, the first side panel 108 can be formed as described herein with respect to the second side panel 112, and vice versa, such that the first and second side panels 108, 112 are formed and arranged opposite and mirroring one another.

As shown in FIG. 1B, a first rail 140 is coupled to an inwardly facing surface 144 of the first side panel 108 and a second rail 148 is coupled to an inwardly facing surface 152 of the second side panel 112. As described in more detail below, each of the first and second rails 140, 148 has a head end 156 arranged adjacent to the head end 132 of the casket assembly 100 and a foot end 160 arranged adjacent to the foot end 136 of the casket assembly 100. Each of the first and second rails 140, 148 also has a mating latch element 164 fixedly coupled opposite the inwardly facing surfaces 144, 152 of the first and second side panels 108, 112.

As described in further detail below, the foot lid portion 120 includes a foot tab 168 foldably arranged at one end of the foot lid portion 120 and two latch elements 172 fixedly coupled to the opposite end of the foot lid portion 120. The foot tab 168 is configured to slide between the foot ends 160 of the first and second rails 140, 148 and the portions of the first and second side panels 108, 112 making up the foot end 136 of the casket assembly 100, and the two latch elements 172 are configured to engage with the two mating latch elements 164 on the first and second rails 140, 148 to removably couple the foot lid portion 120 to the first and second side panels 108, 112. It is understood that the mating latch elements 164 and the latch elements 172 can be interchangeably coupled to the first and second rails 140, 148 and the foot lid portion 120.

As also described in further detail below, the head lid portion 116 includes a head tab 176 foldably arranged at one end of the head lid portion 116 and a central tab 180 foldably arranged at the opposite end of the head lid portion 116. The head tab 176 is configured to slide between the head ends 156 of the first and second rails 140, 148 and the portions of the first and second side panels 108, 112 making up the head end 132 of the casket assembly 100, and the central tab 180 is configured to slide between the foot lid portion 120 and the first and second rails 140, 148. Accordingly, when the head and foot lid portions 116, 120 are coupled to the first and second side panels 108, 112, each of the head and foot lid portions 116, 120 are supported by both the first and second rails 140, 148 such that the lid 114 is arranged inside the casket assembly 100, as shown in FIG. 1A. When the lid 114 is supported by the first and second rails 140, 148 and arranged inside the casket assembly 100, neither of the head or foot lid portions 116, 120 projects above the first and second side panels 108, 112.

As shown in FIG. 1B, the casket assembly 100 further includes two connectors 184. As described in more detail below, each connector 184 is fixedly coupled to one of the first and second side panels 108, 112 and is configured to be received within the other of the first and second side panels 108, 112 to improve the structural integrity of the head and foot ends 132, 136 of the casket assembly 100 where the first and second side panels 108, 112 come together to form portions of the head and foot ends 132, 136 of the casket assembly 100.

Figure 2A:
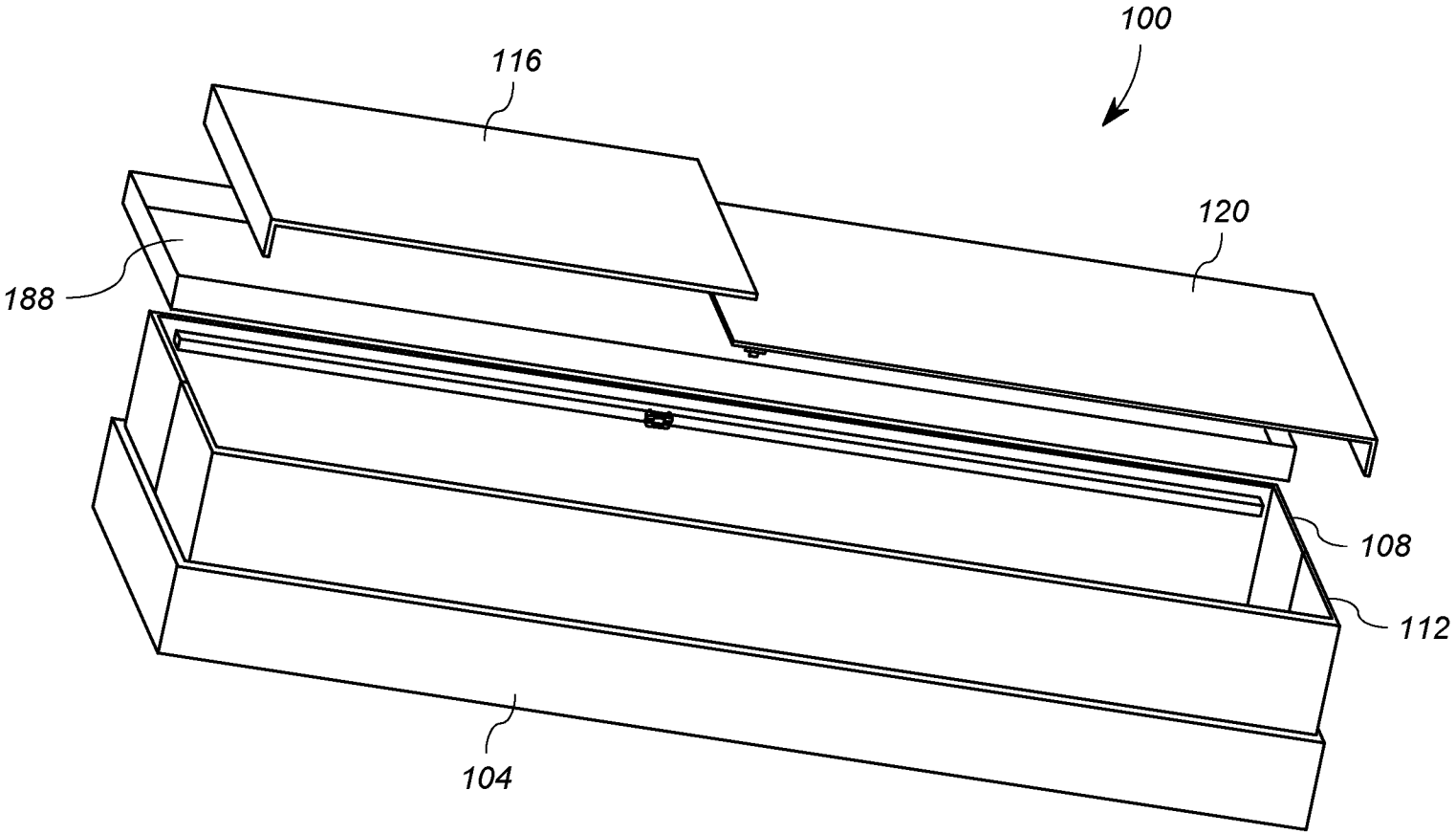
FIG. 2A depicts an exploded top, front perspective view of the casket assembly of FIGS. 1A and 1B, further including an insert.
Figure 2B:
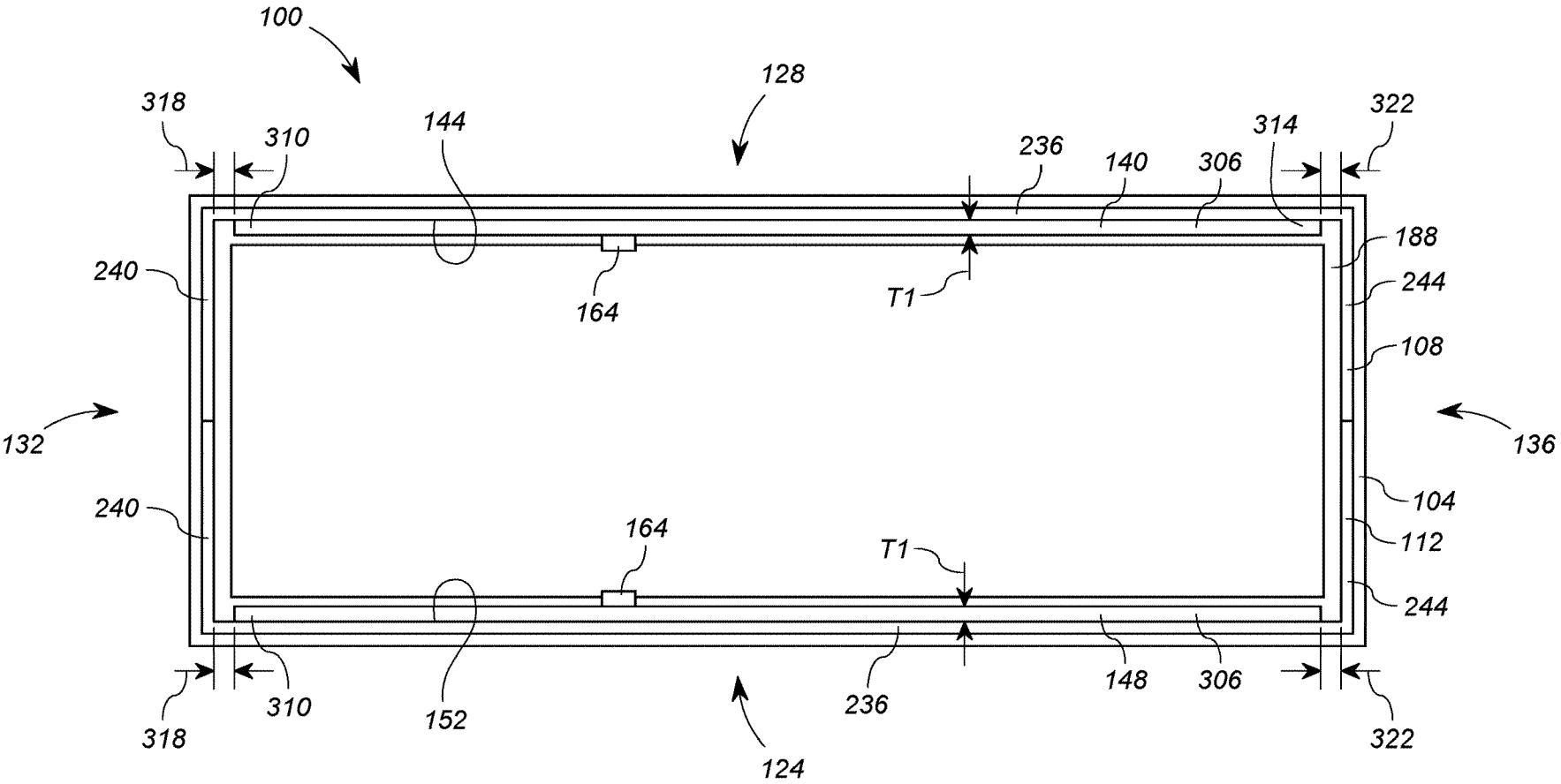
FIG. 2B depicts a top plan view of the casket assembly of FIGS. 1A and 1B including the insert.

FIG. 2A shows an exploded view of the casket assembly 100 and FIG. 2B shows a top plan view of the casket assembly 100 with the lid 114 removed. An insert 188, described in more detail below, may suitably be a tray-like structure configured to be received inside the casket assembly 100 between the first and second side panels 108, 112 and on top of the base 104. When the casket assembly 100 is in use, the deceased is laid upon the insert 188 between the first and second side panels 108, 112. In at least one embodiment, the insert 188 is sized such that when the insert 188 is inserted between the first and second side panels 108, 112, the insert 188 facilitates retaining the first and second side panels 108, 112 against the base 104 to enhance the structural stability and strength of the casket assembly 100.

Figure 3:
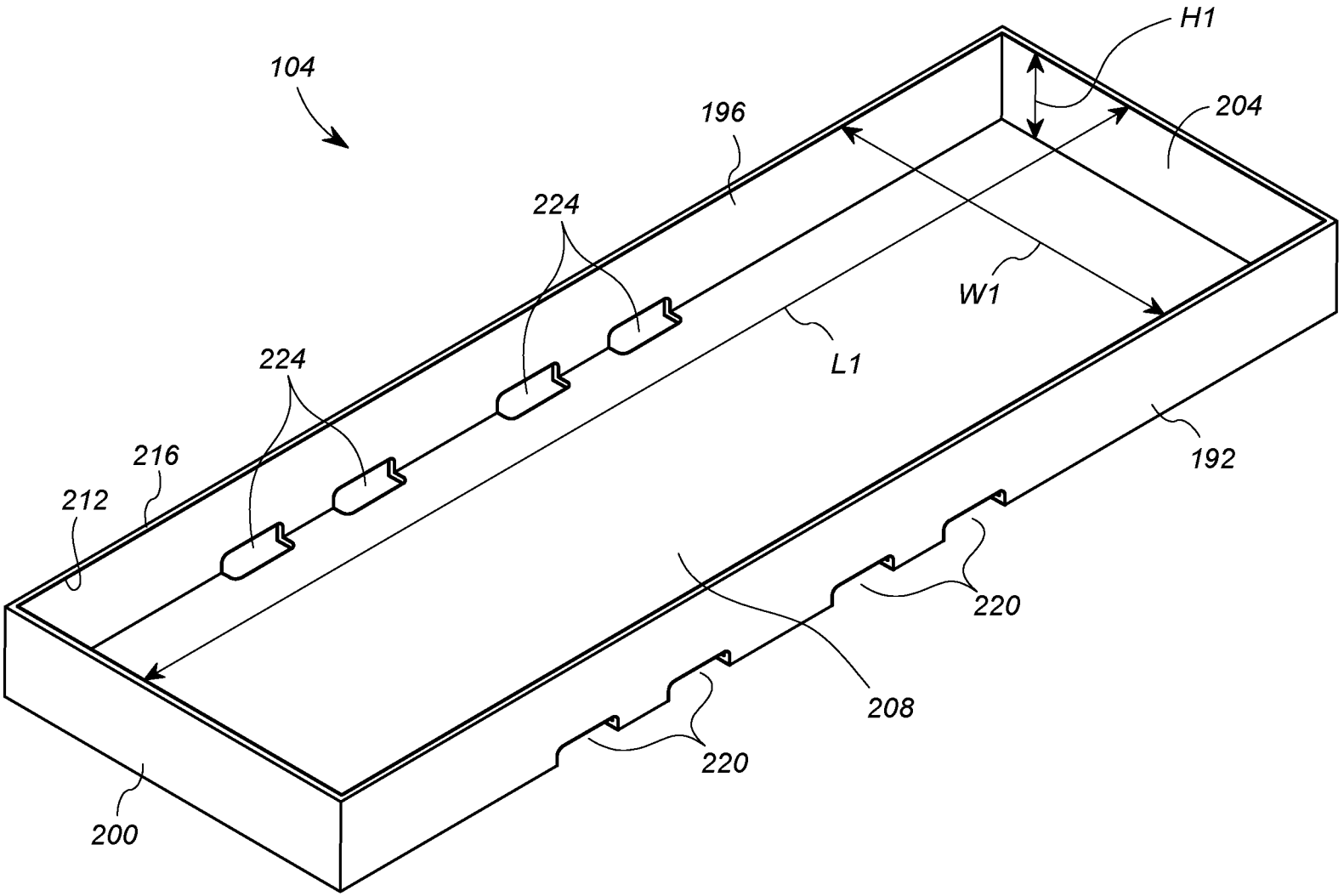
FIG. 3 depicts a top, front perspective view of the base of the casket assembly of FIGS. 1A and 1B.

Further detail regarding the base 104 is provided in reference to FIG. 3. As shown in FIG. 3, the base 104 is shaped as a rectangular box having a first side 192 arranged at the first side 124 of the casket assembly 100 (shown in FIG. 1A), a second side 196 arranged at the second side 128 of the casket assembly 100, a head end 200 arranged at the head end 132 of the casket assembly 100, a foot end 204 arranged at the foot end 136 of the casket assembly 100, and a bottom 208 coupled to the first side 192, the second side 196, the head end 200, and the foot end 204 of the base 104. The base 104 has an open top 212 defined by an open top edge 216 and configured to receive the first and second side panels 108, 112 and the insert 188 therein.

The base 104 also has a length L1, a width W1, and a height H1. The length L1 of the base 104 extends between the head end 200 and the foot end 204 and is, for example, between 74 and 76 inches to accommodate a deceased person of up to six feet tall. In other embodiments, the length L1 can be greater than or less than between 74 and 76 inches to accommodate deceased persons of different height. The width W1 of the base 104 extends between the first side 192 and the second side 196 and is, for example, between 23 and 24 inches to accommodate a deceased person with a shoulder and/or hip width of up to two feet. In other embodiments, the width W1 can be greater than or less than between 23 and 24 inches to accommodate deceased persons of different shoulder and/or hip widths. The height H1 of the base 104 extends between the bottom 208 and the open top edge 216 and is, for example, between four and five inches. The height H1 of the base 104 is sized and configured to retain the insert 188 and a portion of the first and second side panels 108, 112 within the first side 192, the second side 196, the head end 200, and the foot end 204 of the base 104.

The base 104 also includes first side handle openings 220 formed on the first side 192 and the bottom 208 of the base 104 and second side handle openings 224 formed on the second side 196 and the bottom 208 of the base 104. The first and second side handle openings 220, 224 are sized and configured to receive at least a portion of a hand therein to enable lifting and carrying of the casket assembly 100 when the deceased is within the casket assembly 100 (shown in FIG. 1). The first and second side handle openings 220, 224 project inside the casket assembly 100 to further facilitate a grip on the base 104 and weight distribution of the casket assembly 100 while lifting and carrying.

In different embodiments, the base 104 can include different numbers of first and second side handle openings 220, 224. For example, the base 104 can include two first side handle openings 220 and two second side handle openings 224 or four first side handle openings 220 and four second side handle openings 224. In the embodiment shown in the figures, for example, the base 104 includes four first side handle openings 220 and four second side handle openings 224. The number of first and second side handle openings 220, 224 can be selected as a matter of preference considering the appearance and the ease of lifting the casket assembly 100.

The arrangement of the first side handle openings 220 is not symmetrical along the first side 192 of the base 104, but is biased toward the head end 200 of the base 104. This arrangement is advantageous because the head end 132 of the casket assembly 100 is heavier when the deceased is within the casket assembly 100. Thus, for the same reason, the arrangement of the second side handle openings 224 is nonsymmetrical and biased toward the head end 200 of the base 104.

Figure 4:
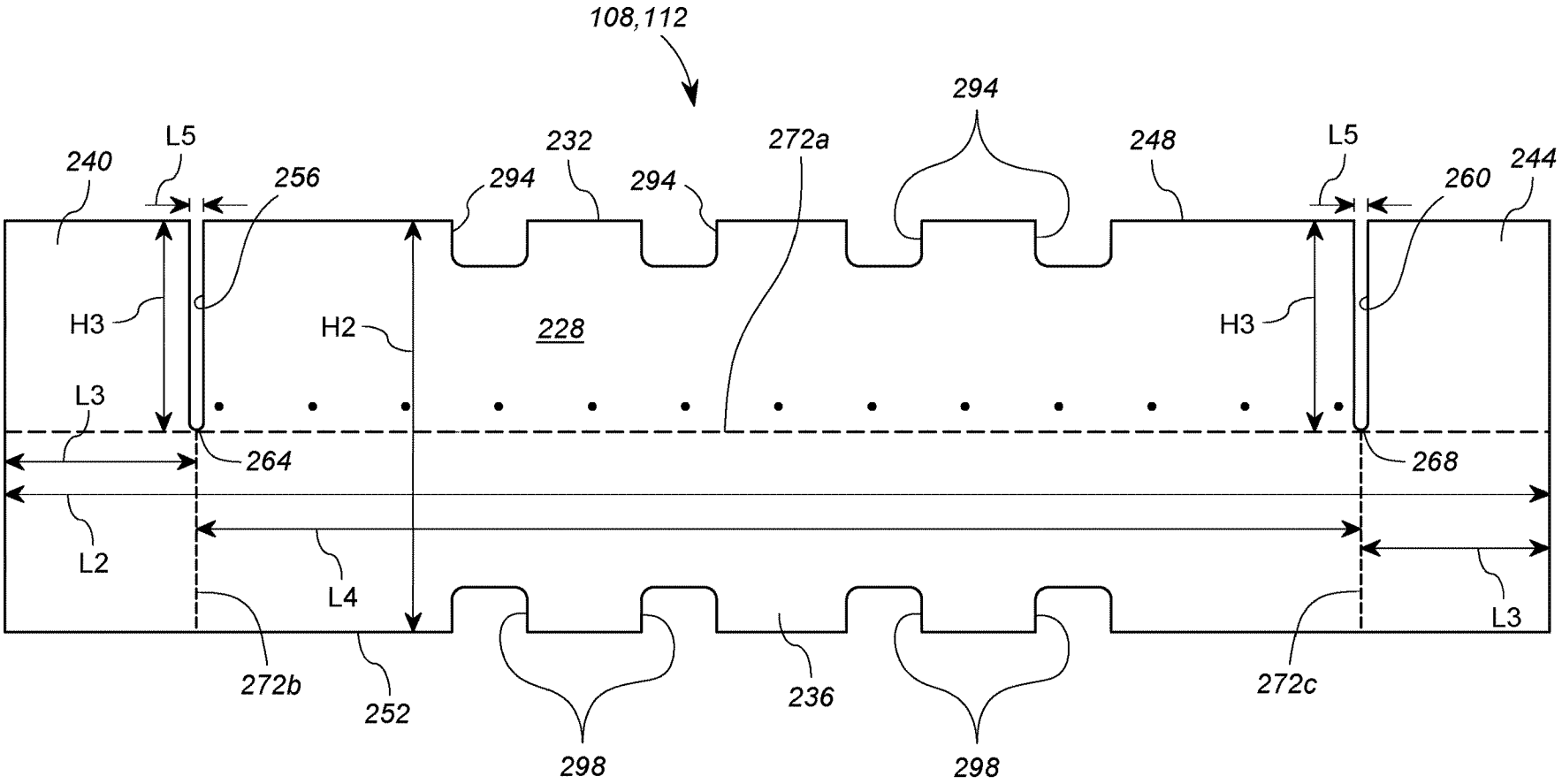
FIG. 4 depicts a top plan view of one of the side panels of the casket assembly of FIGS. 1A and 1B in a flat or unfolded configuration.

As discussed above, the first and second side panels 108, 112 can be formed from folded corrugated paper or a similar material. FIG. 4 shows one of the first and second side panels 108, 112 in a flat or unfolded configuration, before it is folded. In the unfolded configuration, the first side panel 108 and the second side panel 112 are identical to one another. Accordingly, the description of the side panel with respect to FIG. 4 applies to both the first and the second side panels 108, 112. When in the unfolded configuration, each of the first and second side panels 108, 112 includes a first surface 228, which is shown in FIG. 4, and a second surface 232, arranged opposite the first surface 228. Each of the first and second side panels 108, 112 also includes a main body portion 236, a left end portion 240, and a right end portion 244. The left end portion 240 is arranged on the left hand side of the drawing as shown in FIG. 4, and the right end portion 244 is arranged opposite the left end portion 240, on the right hand side of the drawing as shown in FIG. 4. The main body portion 236 is interposed between the left end portion 240 and the right end portion 244. Each of the first and second side panels 108, 112 also includes a first edge 248 and a second edge 252 forming opposite edges of the first and second side panels 108, 112 and extending along the left end portion 240, the main body portion 236, and the right end portion 244 and extending between the first surface 228 and the second surface 232.

In the unfolded configuration, each of the first and second side panels 108, 112 has a length L2 and a height H2. The length L2 is, for example, between 99 and 100 inches long, including the left and right end portions 240, 244 and the main body portion 236. Each of the left and right end portions 240, 244 has a length L3 of, for example, between 11 and 13 inches, and the main body portion 236 has a length L4 of, for example, between 73 and 76 inches. The height H2 extends from the first edge 248 to the second edge 252 of the first and second panels 108, 112 and is, for example, between 26 and 28 inches.

Each of the first and second side panels 108, 112 further includes a left slit 256 projecting into the first side panel 108 from the first edge 248 to partially separate the left end portion 240 from the main body portion 236. The left slit 256 projects a height H3 that extends approximately half way into the height H2. In other words, the left slit 256 projects a height H3 of, for example, between 13 and 14 inches from the first edge 248. The left slit 256 is open along the first edge 248 for a length L5 extending in the same direction as the length L2. The length L5 of the left slit 256 at the first edge 248 is, for example, between 0.25 and 1 inches. At a terminating end 264 of the left slit 256, arranged opposite the first edge 248, the left slit 256 tapers to form a point at the height H3 of the left slit 256.

Each of the first and second side panels 108, 112 also includes a right slit 260, which is substantially similar to the left slit 256, except that the right slit 260 projects from the first edge 248 to partially separate the right end portion 244 from the main body portion 236. The right slit 260 also projects the height H3 from the first edge 248 and is open along the first edge 248 for the length L5 in the same direction as the length L2. The right slit 260 also tapers to a point at a terminating end 268 arranged opposite the first edge 248.

Each of the first and second side panels 108, 112 also includes score lines 272, shown as dashed lines, formed in at least one of the first and second surfaces 228, 232. The score lines 272 provide areas of the panel which are weaker and have less structural stability than the remaining portions of the first and second side panels 108, 112 to facilitate folding the first and second side panels 108, 112 along the score lines 272. In each of the first and second side panels 108, 112, a first score line 272*a* is formed parallel to and extending along the length L2 of each of the first and second panels 108, 112 halfway between the first edge 248 and the second edge 252. In other words, the first score line 272*a* extends through the center of the left end portion 240, the main body portion 236, and the right end portion 244 and abuts the terminating ends 264, 268 of the left and right slits 256, 260.

Figure 5:
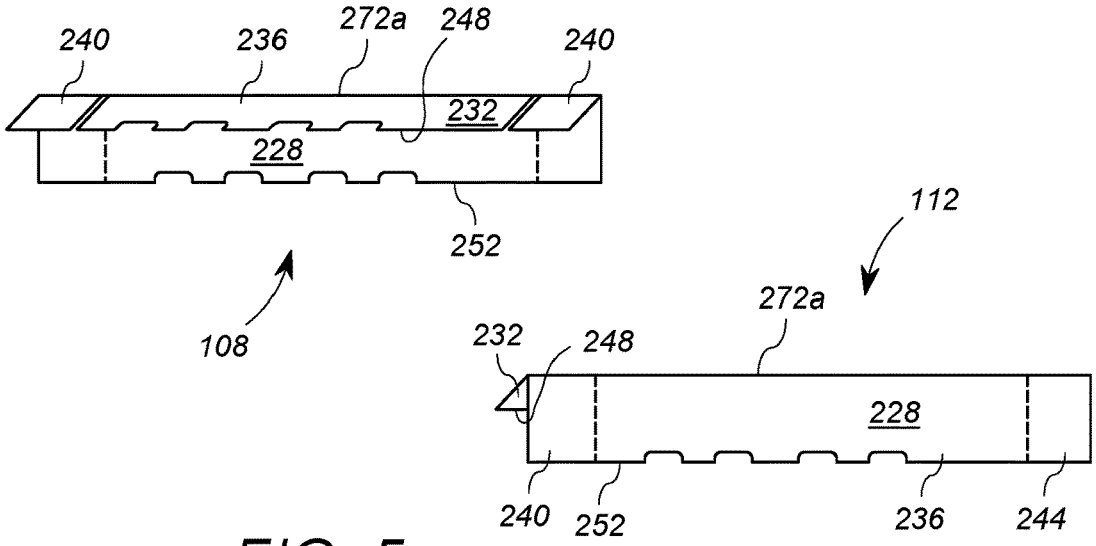
FIG. 5 depicts a front perspective view of both of the side panels of the casket assembly of FIGS. 1A and 1B being folded between the unfolded configuration and a semi-folded configuration.

As shown in FIG. 5, the first score line 272*a* facilitates folding the left end portion 240, the main body portion 236, and the right end portion 244 of each of the first and second side panels 108, 112 in half such that the first edge 248 and the second edge 252 are brought adjacent to one another. As shown, the first side panel 108 is folded along the first score line 272*a* such that the first surface 228 is folded onto itself and the second surface 232 is exposed. Conversely, the second side panel 112 is folded along the first score line 272*a* such that the second surface 232 is folded onto itself and the first surface 228 is exposed.

Figure 6:
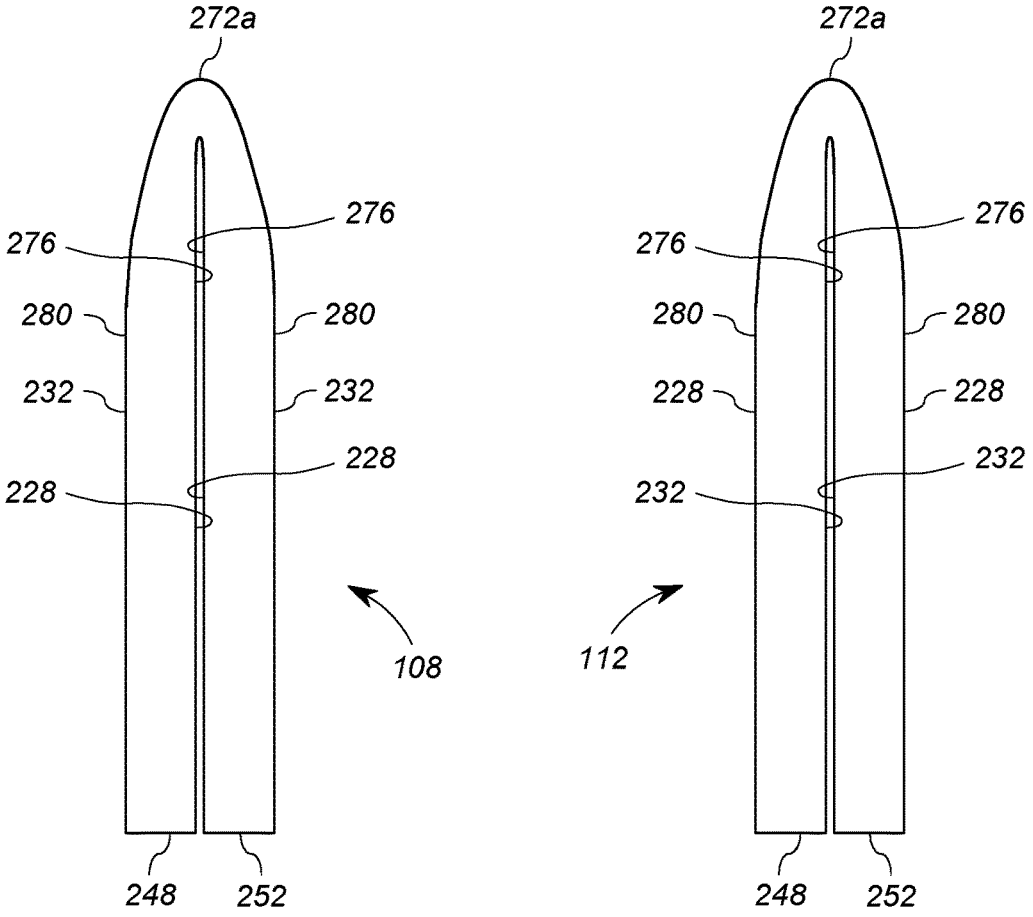
FIG. 6 depicts a side end view of both of the side panels of the casket assembly of FIGS. 1A and 1B in the semi-folded configuration.

When the first and second edges 248, 252 of the first and second side panels 108, 112 are brought adjacent to one another, the first and second side panels 108, 112 are in a semi-folded configuration, shown in FIG. 6. In the semi-folded configuration, the surface of the panel which was folded onto itself forms two adjacent surfaces 276, and the opposite surface of the panel, which was not folded onto itself and is exposed, forms two non-adjacent surfaces 280. As shown, the first surface 228 of the first side panel 108 forms the two adjacent surfaces 276 and the second surface 232 of the first side panel 108 forms the two non-adjacent surfaces 280 of the first side panel 108. Conversely, the second surface 232 of the second side panel 112 forms the two adjacent surfaces 276 and the first surface 228 of the second side panel 112 forms the two non-adjacent surfaces 280 of the second side panel 112. In this way, the first side panel 108 and the second side panel 112 are folded in opposite directions to form opposite, mirroring side panels in the semi-folded configuration.

Returning to FIG. 4, a second score line 272*b* is formed in each of the first and second side panels 108, 112 extending from the center of the terminating end 264 of the left slit 256 to the second edge 252, and is formed perpendicularly relative to the first score line 272*a*. Similarly, a third score line 272*c* is formed in each of the first and second side panels 108, 112 extending from the center of the terminating end 268 of the right slit 260 to the second edge 252, and is formed parallel to the second score line 272*b* and perpendicularly relative to the first score line 272*a*. In other words, the left slit 256 and the second score line 272*b* form a border between the left end portion 240 and the main body portion 236, and the right slit 260 and the third score line 272*c* form a border between the right end portion 244 and the main body portion 236. The second and third score lines 272*b*, 272*c* facilitate folding the left and right end portions 240, 244, respectively, toward the main body portion 236 to fold the first and second side panels 108, 112 from the semi-folded configuration to the folded configuration.

Figure 7:
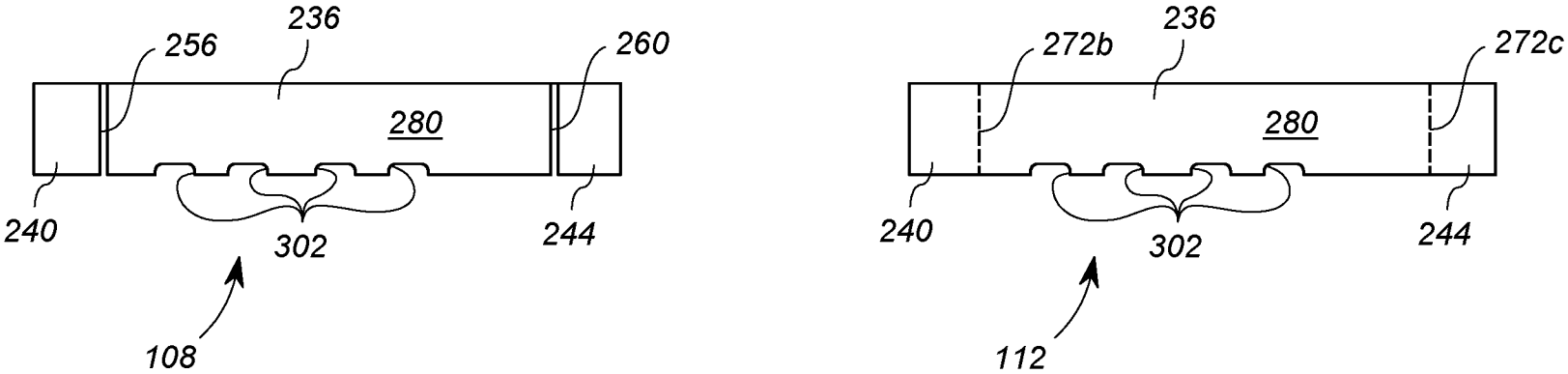
FIG. 7 depicts a front plan view of both of the side panels of the casket assembly of FIGS. 1A and 1B in the semi-folded configuration.

As shown in FIG. 5 and described above, the first and second side panels 108, 112 are folded in opposite directions so as to form opposite and mirroring side panels in the semi-folded configuration. Because each left slit 256 is aligned with the second score line 272*b* and each right slit 260 is aligned with the third score line 272*c* along the length of the respective side panel 208, 212, in the semi-folded configuration, the left slits 256 overlap the second score lines 272*b*, and the right slits 260 overlap the third score lines 236*c*. Thus, as shown in FIG. 7, the left slit 256 and the right slit 260 are visible on the first side panel 108 and the second and third score lines 272*b*, 272*c* are visible on the second side panel 112. Also shown in FIG. 7, folding each of the first and second side panels 108, 112 along the first score line 272*a*, reduced the height H2 (shown in FIG. 4) of the first and second side panels 108, 112 by approximately half. In other words, once the first and second side panels 108, 112 have been folded along the first score line 272*a* into the semi-folded configuration, the height H2 of the first and second side panels 108, 112 is reduced to approximately the height H3 (shown in FIG. 4) of the left and right slits 256, 260. The height H3 is between, for example, approximately 13 and 14 inches.

Figure 8:
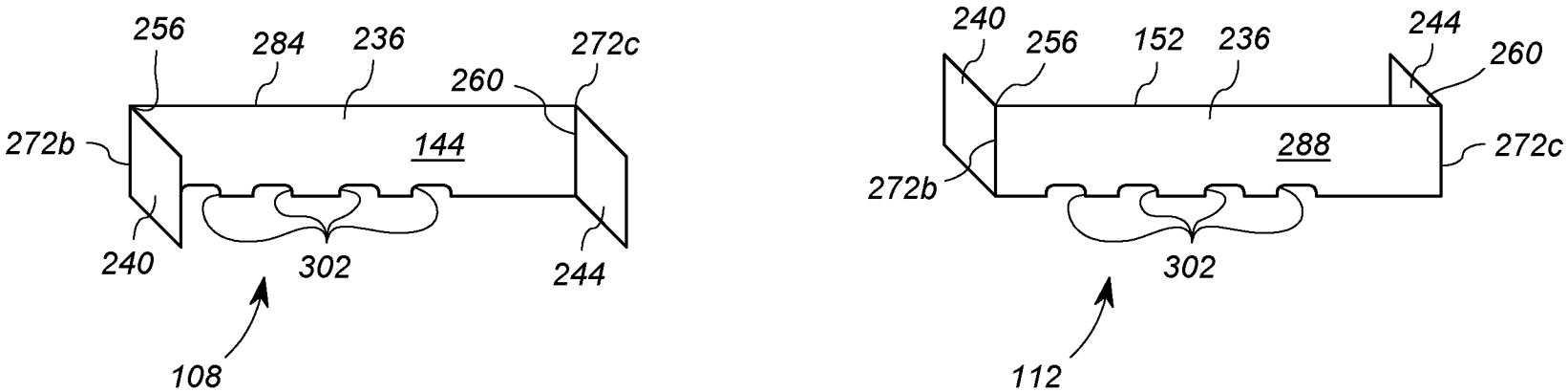
FIG. 8 depicts a top, front perspective view of both of the side panels of the casket assembly of FIGS. 1A and 1B in a folded configuration.

In FIG. 8, the first and second side panels 108, 112 are shown in the folded configuration. The first and second side panels 108, 112 are folded from the semi-folded configuration (shown in FIG. 7) into the folded configuration by folding the left end portions 240 along the second score lines 272*b* over the left slits 256 and folding the right end portions 244 along the third score lines 272*c* over the right slits 260. In other words, the first and second score lines 272*b*, 272*c* facilitate folding the left and right end portions 240, 244 over the left and right slits 256, 260. The left and right end portions 240, 244 are folded at approximately right angles relative to the main body portion 236. As a result, each of the first and second side panels 108, 112 has a reduced length that is approximately equal to the length L4 of the main body portion 236.

In the folded configuration, each of the first and second side panels 108, 112 forms a "U" or a "C" shape such that the non-adjacent surfaces 280 of the first side panel 108 form the inwardly facing surface 144 and an outwardly facing surface 284 of the first side panel 108, and the non-adjacent surfaces 280 of the second side panel 112 form the inwardly facing surface 152 and an outwardly facing surface 288 of the second side panel 112. More specifically, the inwardly facing surfaces 144, 152 of each of the first and second side panels 108, 112 are formed from the non-adjacent surface 280 of the respective side panel 108, 112 which included the left and right slits 256, 260 in the semi-folded configuration. Conversely, the outwardly facing surfaces 284, 288 of each of the first and second side panels 108, 112 are formed from the non-adjacent surfaces 280 of the respective side panel 108, 112 which included the second and third score lines 272*b*, 272*c* in the semi-folded configuration. As a result, at each corner formed where the left and right end portions 240, 244 are folded relative to the main body portion 236, the left and right slits 256, 260 are arranged on the inside and the second and third score lines 272*b*, 272*c* are arranged on the outside of the "U" or "C" shape.

In summary, as shown in FIG. 4, the first and second side panels 108, 112 are identical in the flat or unfolded configuration with a first surface 228 visible in FIG. 4 and a second surface 232 opposite the first surface 228. As shown in FIG. 5, when the first and second side panels 108, 112 are folded from the unfolded configuration toward the semi-folded configuration, the first and second side panels 108, 112 are folded in opposite directions about the first score line 272*a* to bring the first edges 248 to abut the second edges 252. Accordingly, as shown in FIG. 6, in the semi-folded configuration, the second surface 232 of the first side panel 108 becomes non-adjacent surfaces 280 and the first surface 228 of the second side panel 112 becomes non-adjacent surfaces 280. Finally, as shown in FIG. 8, when the first and second side panels 108, 112 are folded from the semi-folded configuration toward the folded configuration, the left and right end portions 240, 244 of the first and second side panels 108, 112 are folded toward the main body portions 236 in opposite directions about the second and third score lines 272*b*, 272*c*, respectively. The non-adjacent surfaces 280 of the first and second side panels 108, 112 in the semi-folded configuration become the inwardly facing surfaces 144, 152 and the outwardly facing surfaces 284, 288 of the first and second side panels 108, 112, respectively, in the folded configuration. As a result, the first and second side panels 108, 112 are oppositely formed and mirror one another and are thus configured to cooperate with the base 104 (shown in FIG. 3) to form the first side 124, the second side 128, the head end 132, and the foot end 136 of the casket assembly 100 (shown in FIG. 1).

Figure 9:
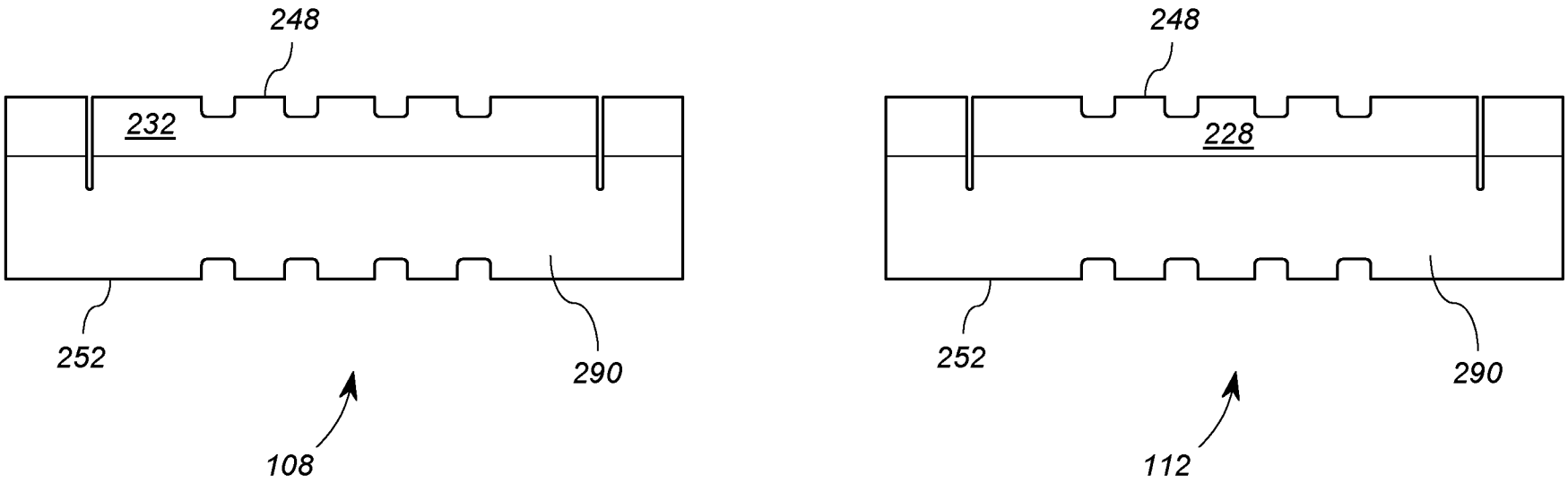
FIG. 9 depicts a bottom plan view of both of the side panels of the casket assembly of FIGS. 1A and 1B in the flat or unfolded configuration

Turning now to FIG. 9, the second surface 232 of the first side panel 108 and the first surface 228 of the second side panel 112 are visible. In at least one embodiment, when the first and second side panels 108, 112 are in the flat or unfolded configuration, a covering material 290 can be applied to the second surface 232 of the first side panel 108 and to the first surface 228 of the second side panel. The covering material 290 is applied to the left end portion 240, the right end portion 244, and the main body portion 236 of both of the first and second side panels 108, 112 such that it extends from the second edge 252 of each of the side panels 108, 112, covers the first score lines 272*a* (shown in FIG. 4), and extends at least partially along the left and right slits 256, 260. Accordingly, when the first and second side panels 108, 112 are folded, as described above, into the folded configuration, the covering material 290 is arranged on the outwardly facing surface 284 of the first side panel 108 and the outwardly facing surface 288 of the second side panel 112 and also extends over the first score lines 272*a* and onto at least a portion of the inwardly facing surfaces 144, 152 of the first and second side panels 108, 112.

The covering material 290 can be, for example, a felt material and can be applied, for example, by laminating the surfaces of the first and second side panels 108, 112 to which the covering material 290 is applied. The covering material 290 improves the aesthetic appearance of portions of the first and second side panels 108, 112 which are visible in the casket assembly 100. Thus, in at least one embodiment, the covering material 290 is applied only to a portion of each of the first and second side panels 108, 112 which will be visible when the first and second side panels 108, 112 are arranged in the casket assembly 100 as shown in FIG. 1. In an alternative embodiment, the covering material 290 can be applied to the entirety of the second surface 232 of the first side panel 108 and the first surface 228 of the second side panel 112. In yet another alternative embodiment, the covering material 290 can be applied to the first and second surfaces 228, 232 of both of the first and second side panels 108, 112.

It is understood that the first and second side panels 108, 112 can be folded in the manner described above, or the first side panel 108 can be folded as described above with respect to the second side panel 112 and the second side panel 112 can be folded as described above with respect to the first side panel 108. Either manner of folding is acceptable so long as the first and second side panels 108, 112 are oppositely formed and mirror one another in the folded configuration. Accordingly, the covering material 290 is applied to whichever of the first or second surface 228, 232 of the first and second side panels 108, 112 forms the non-adjacent surfaces 280 in the semi-folded configuration.

As shown in FIG. 4, each of the first and second side panels 108, 112 also includes first edge handle openings 294 projecting into the main body portion 236 from the first edge 248 and second edge handle openings 298 projecting into the main body portion 236 from the second edge 252. The first edge handle openings 294 and the second edge handle openings 298 are aligned with one another and mirror one another on opposite sides of the first score line 272*a*. Thus, when each of the first and second side panels 108, 112 is folded at the first score line 272*a* and the first and second edges 248, 252 are brought adjacent to one another, the first and second edge handle openings 294, 298 are also brought adjacent to one another and align to form handle openings 302 (shown in FIGS. 7 and 8).

Each of the first and second side panels 108, 112 includes four first edge handle openings 294 and four second edge handle openings 298. As shown in FIG. 4, the four first and second edge handle openings 294, 298 are not arranged symmetrically along the first and second edge 248, 252 of the first and second panels 108, 112, but are biased toward the left end portion 240. When the first and second side panels 108, 112 are folded into the folded configuration shown in FIG. 8, and the first side panel 108 and the second side panel 112 are arranged to mirror one another, the handle openings 302 also mirror one another. Accordingly, the handle openings 302 are configured and arranged such that, when the first and second side panels 108, 112 are partially received within the base 104, the handle openings 302 of the first side panel 108 align with the first side handle openings 220 and the handle openings 302 of the second side panel 112 align with the second side handle openings 224 formed in the base 104. In an embodiment wherein the base 104 includes two first side handle openings 220 and two second side handle openings 224, the first and second side panels 108, 112 each also include two first edge handle openings 294 and two second edge handle openings 298 to align with the first and second side handle openings 220, 224.

As discussed above, the casket assembly 100 includes first and second rails 140, 148 coupled to the respective side panels 108, 112. FIGS. 1B and 2B shows the first and second rails 140, 148 assembled within the casket assembly 100. The first rail 140 is assembled within the casket assembly 100 via the inwardly facing surface 144 of the first side panel 108 and the second rail 148 is assembled within the casket assembly 100 via the inwardly facing surface 152 of the second side panel 112. Accordingly, when the first and second side panels 108, 112 are in the unfolded configuration, the first rail 140 is coupled to the second surface 232 of the first side panel 108 between the left and right slits 256, 260 and the second rail 248 is coupled to the first surface 228 of the second side panel 112 between the left and right slits 256, 260. Thus, when the first and second side panels 108, 112 are folded as shown in FIGS. 5 and 8, the first rail 140 is arranged on the inwardly facing surface 144 of the first side panel 108 between the left and right slits 256, 260 and the second rail 148 is arranged on the inwardly facing surface 152 of the second side panel 112 between the left and right slits 256, 260.

Figure 10:
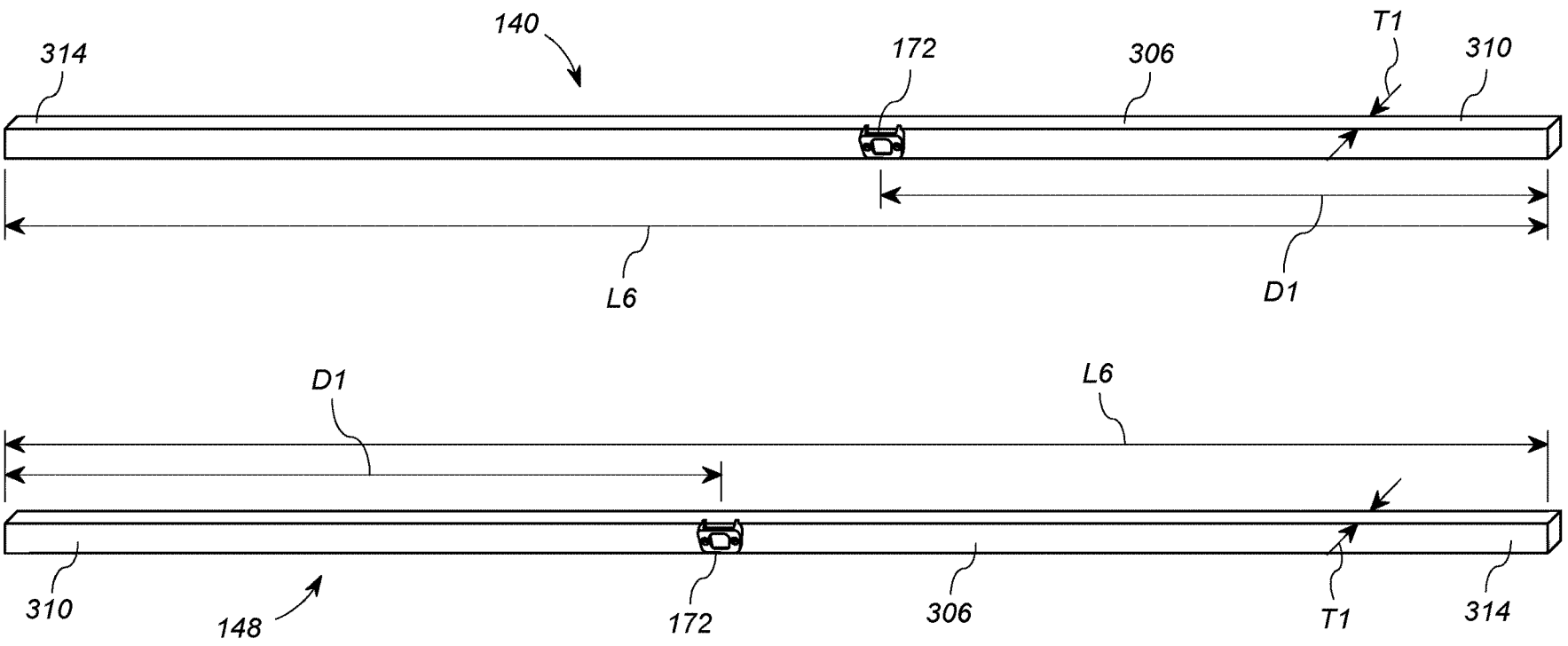
FIG. 10 depicts a front perspective view of two rails configured to be coupled to the two side panels of the casket assembly of FIGS. 1A and 1B.

Additional detail regarding the rails 140, 148 is provided with reference to FIG. 10. FIG. 10 shows the first rail 140 and the second rail 148 apart from the side panels, 108, 112. The first and second rails 140, 148 are identical to one another except that they are configured to mirror one another when coupled to the first and second side panels 108, 112. Each of the first and second rails 140, 148 includes a support 306 coupled to the first and second side panels 108, 112, respectively, and a latch element 172 fixedly coupled to the opposite side of the support 306. Each of the supports 306 also has a thickness T1 extending from the side of the support 306 that is coupled to the side panel 108, 112 to the side of the support 306 to which the latch element 172 is fixedly coupled and a length L6 extending from a head end 310 to a foot end 314 of the support 306.

The latch elements 172 are fixedly coupled to the supports 306 at a position such that, when the first and second side panels 108, 112 are partially received within the casket assembly 100, the latch elements 172 are arranged nearer to the head end 132 than the foot end 136 of the casket assembly 100. Accordingly, the latch elements 172 are fixedly coupled to the supports 306 at a distance D1 of, for example, between 32 and 34 inches from the head ends 310 of the supports 306. In a particular embodiment, the distance D1 is approximately 33 inches. When the first and second side panels 108, 112 are partially received within the base 104 (as shown in FIG. 2B), the latch elements 172 are aligned with one another, at the distance D1 (shown in FIG. 10) from the head end 132 of the casket assembly 100.

When the supports 306 are coupled to the first and second side panels 108, 112, as shown in FIG. 2B, they project from the first and second side panels 108, 112 into the casket assembly 100 to the thickness T1. Additionally, the length L6 (shown in FIG. 10) is shorter than the length L4 (shown in FIG. 3) of the main body portions 236 of the first and second side panels 108, 112. The length L6 is, for example, between 0.5 and 1 inches shorter than the length L4. In other words, the length L6 is, for example, between 72 and 75 inches long. In a particular embodiment, the length L6 is 73.5 inches. Accordingly, as shown in FIG. 2B, when the first rail 140 is fastened to the first side panel 108 such that the support 306 is centered on the main body portion 236, a head end gap 318 is formed between the head end 310 of the support 306 and the left end portion 240 of the first side panel 108, and a foot end gap 322 is formed between the foot end 314 of the support 306 and the right end portion 244 of the first side panel 108. Similarly, when the second rail 148 is fastened to the second side panel 112 such that the support 306 is centered on the main body portion 236 such that, when the second side panel 112 is in the folded configuration, a head end gap 318 is formed between the head end 310 of the support 306 and the right end portion 244 of the second side panel 112, and a foot end gap 322 is formed between a foot end 314 of the support 306 and the left end portion 240 of the second side panel 112. The head end gaps 318 and the foot end gaps 322 are the same size as one another and each is half of the difference between the length L4 of the main body portion 136 (shown in FIG. 3) and the length L6 of the support 306 (shown in FIG. 10).

Figure 11:
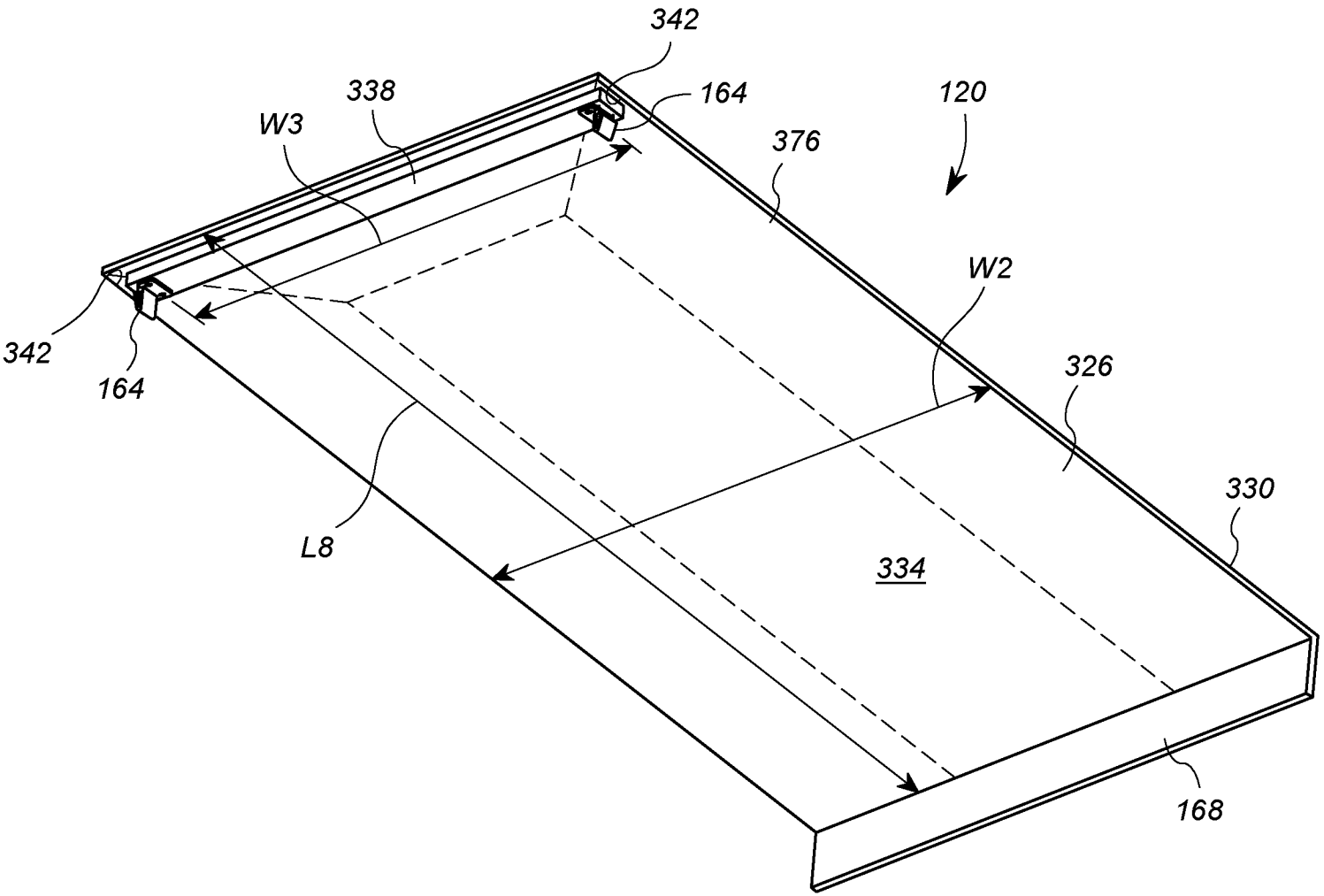
FIG. 11 depicts a bottom, front perspective view of the foot lid portion of the casket assembly of FIGS. 1A and 1B.

Turning now to FIG. 11, the foot lid portion 120, configured to be coupled to the first and second side panels 108, 112 at the foot end 136 of the casket assembly 100, is shown in more detail. The foot lid portion 120 includes a main body 326 having a top surface 330 and a bottom surface 334. The foot lid portion 120 also includes the foot tab 168, which foldably projects from the main body 326.

The main body 326 of the foot lid portion 120 has a width W2 sized to span the distance between the first side panel 108 and the second side panel 112 when the first and second side panels 108, 112 are partially received within the base 104. Accordingly, the width W2 of the foot lid portion 120 is equal to the length L3 of one of the left end portions 240 plus the length L3 of one of the right end portions 244 of the first and second side panels 108, 112. In a particular embodiment, the width W2 of the foot lid portion 120 is approximately 23.625 inches.

The main body 326 of the foot lid portion 120 also has a length L8 sized to extend from the foot end 136 of the casket assembly 100 beyond the latch elements 172 on the first and second rails 140, 148 coupled to the first and second side panels 108, 112, respectively. The length L8 of the foot lid portion 120 is, for example, between 42 and 44 inches. In a particular embodiment, the length L8 of the foot lid portion 120 is approximately 43 inches.

The foot lid portion 120 further includes a support panel 338, fixedly coupled to the bottom surface 334 of the main body 326, and the mating latch elements 164 coupled to the support panel 228 opposite the main body 326. The support panel 338 has a width W3 which is less than the width W2 of the foot lid portion 120. The mating latch elements 164 are coupled to the support panel 338 at opposite ends of the width W3. The mating latch elements 164 project downwardly from the bottom surface 334 of the foot lid portion 120 and are positioned and configured to removably engage with the latch elements 172 on the first and second rails 140, 148 on the first and second side panels 108, 112, respectively. Accordingly, the support panel 338 is centered on the main body 326 of the food lid portion 120 to form a gap 342 on either side of the support panel 338. The gap 342 is wider than the thickness T1 (shown in FIG. 10) of the supports 306 of the first and second rails 140, 144. Accordingly, when the foot lid portion 120 is received between the first and second side panels 108, 112 of the casket assembly 100 (as shown in FIG. 1A), the bottom surface 334 of the foot lid portion 120 rests on the first and second rails 140, 144 such that the supports 306 are received within the gaps 342 and do not interfere with the support panel 338 or the mating latch elements 164.

Figure 12:
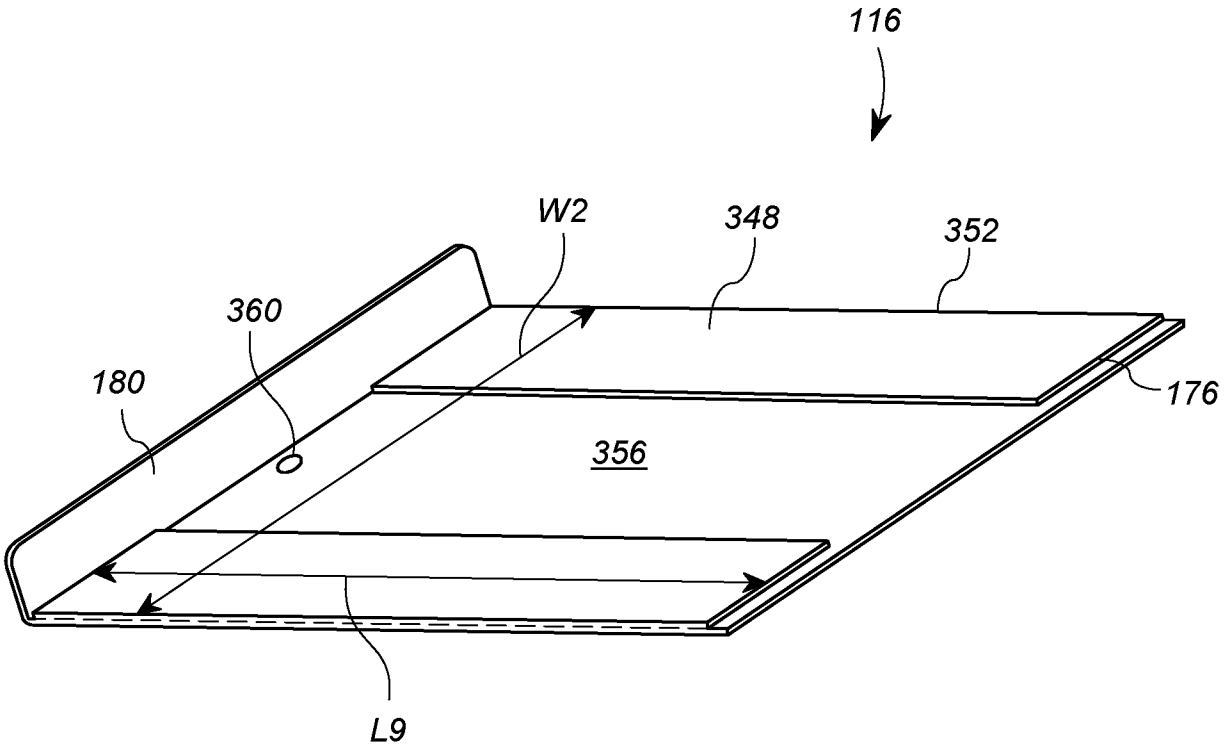
FIG. 12 depicts a bottom, front perspective view of the head lid portion of the casket assembly of FIGS. 1A and 1B.

Turning now to FIG. 12, the head lid portion 116, configured to be coupled to the first and second side panels 108, 112 at the head end 132 of the casket assembly 100, is shown in more detail. The head lid portion 116 includes a main body 348 having a top surface 352 and a bottom surface 356. The head lid portion 116 also includes the central tab 176 and the head tab 180, which foldably project from opposite ends of the main body 348.

Like the main body 326 of the foot lid portion 112, the main body 348 of the head lid portion 116 also extends the width W2 to span the distance between the first side panel 108 and the second side panel 112 when the first and second side panels 108, 112 are received within the base 104. The head lid portion 116 also has a length L9, for example, between 31 and 33 inches. In a particular embodiment, the length L9 of the head lid portion 116 is approximately 32.110 inches.

In at least one embodiment, the head lid portion 116 also includes a finger hole 360 formed in the main body 348. The finger hole 360 extends through both of the top and bottom surfaces 352, 356 of the main body 348 and is sized to receive a portion of a finger therethrough. In a particular embodiment, the finger hole 360 has a diameter of approximately 1 inch. The finger hole 360 enables a finger inserted through the finger hole 360 to grip and pull the main body 348 of the head lid portion 116 to remove the head lid portion 116 from the first and second side panels 108, 112 of the casket assembly 100.

Figure 13:
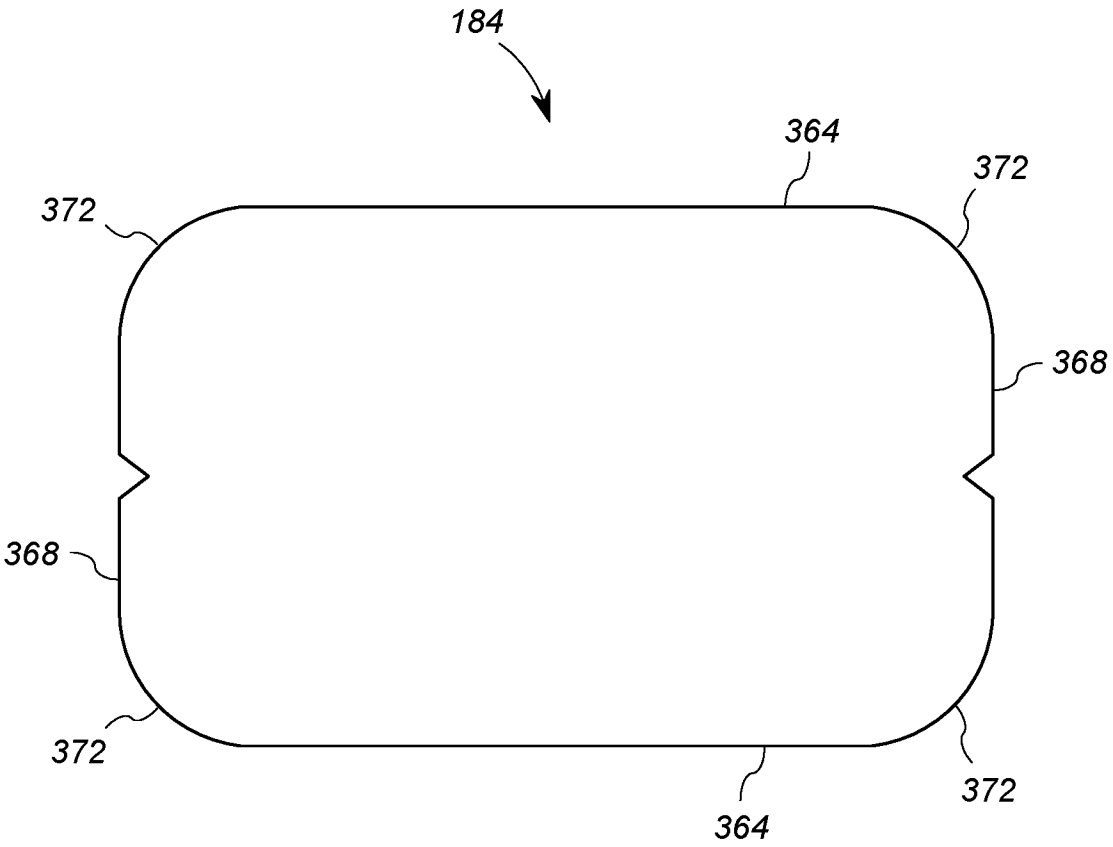
FIG. 13 depicts a top plan view of a connector to be received within the side panels of the casket assembly of FIGS. 1A and 1B.
Figure 14:
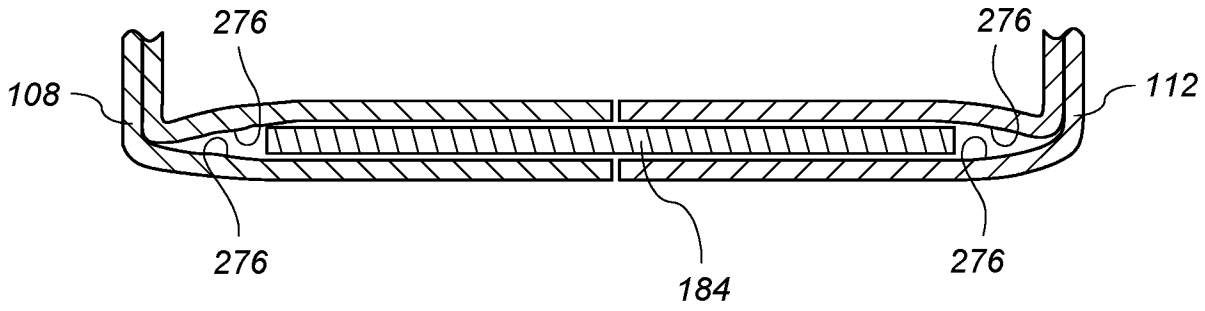
FIG. 14 depicts a top cross-sectional view of the connector of FIG. 13 received within the side panels of the casket assembly of FIGS. 1A and 1B.

Turning now to FIG. 13, one of the connectors 184, configured to connect the first and second side panels 108, 112 to one another, is shown in more detail. The casket assembly 100 includes two connectors 184, one connecting the first and second side panels 108, 112 at the head end 132 of the casket assembly 100 and another connecting the first and second side panels 108, 112 at the foot end 136 of the casket assembly 100. Each connector 184 is substantially shaped as a rectangle having two longer sides 364, two shorter sides 368, and four rounded corners 372 between the longer sides 364 and the shorter sides 368. As shown in FIG. 1B, the connectors 184 are received between the adjacent surfaces 276 (shown in FIG. 6) of the first and second side panels 108, 112 in the folded configuration to connect the first and second side panels 108, 112 to one another. Thus, the longer sides 364 of the connector 184 are shorter than the length L3 of one of the left end portions 240 plus the length L3 of one of the right end portions 244 of the first and second side panels 108, 112, and the shorter sides 368 of the connector 184 are shorter than the height H3 of the first and second side panels 108, 112 in the folded configuration. As shown in FIG. 14, when the connector 184 is received between the adjacent surfaces 276 of the first and second side panels 108, 112 to connect the first and second side panels 108, 112 together, the connector 184 provides a rigid body at the junction of the first and second side panels 108, 112 to maintain the first and second side panels 108, 112 in a substantially co-planar arrangement with respect to one another.

The first and second side panels 108, 112 can be fastened in the folded configurations shown in FIG. 8 by, for example, gluing the adjacent surfaces 276 of the first side panel 108 to one another and gluing the adjacent surfaces 276 of the second side panel 112 to one another. Fastening the first and second side panels 108, 112 in the folded configurations prevents unintentional unfolding of the first and second side panels 108, 112. The connectors 184 can be fastened between the adjacent surfaces 276 of one of the first and second side panels 108, 112 before the adjacent surfaces 276 are fastened together. Alternatively, the connectors 184 can be inserted between the adjacent surfaces 276 after the adjacent surfaces 276 are fastened to one another. In which case, the adjacent surfaces 276 are fastened together in such a way that the connectors 184 can be inserted therebetween. As another alternative, each of the connectors 184 can be fastened between the adjacent surfaces 276 of one of the first and second side panels 108, 112 and can be inserted between the fastened adjacent surfaces 276 of the other of the first and second side panels 108, 112. Regardless of the manner in which the connectors 184 are inserted into the first and second side panels 108, 112, the rounded corners 372 of the connectors 184 facilitate insertion of the connectors 184 between the adjacent surfaces 276.

Figure 15:
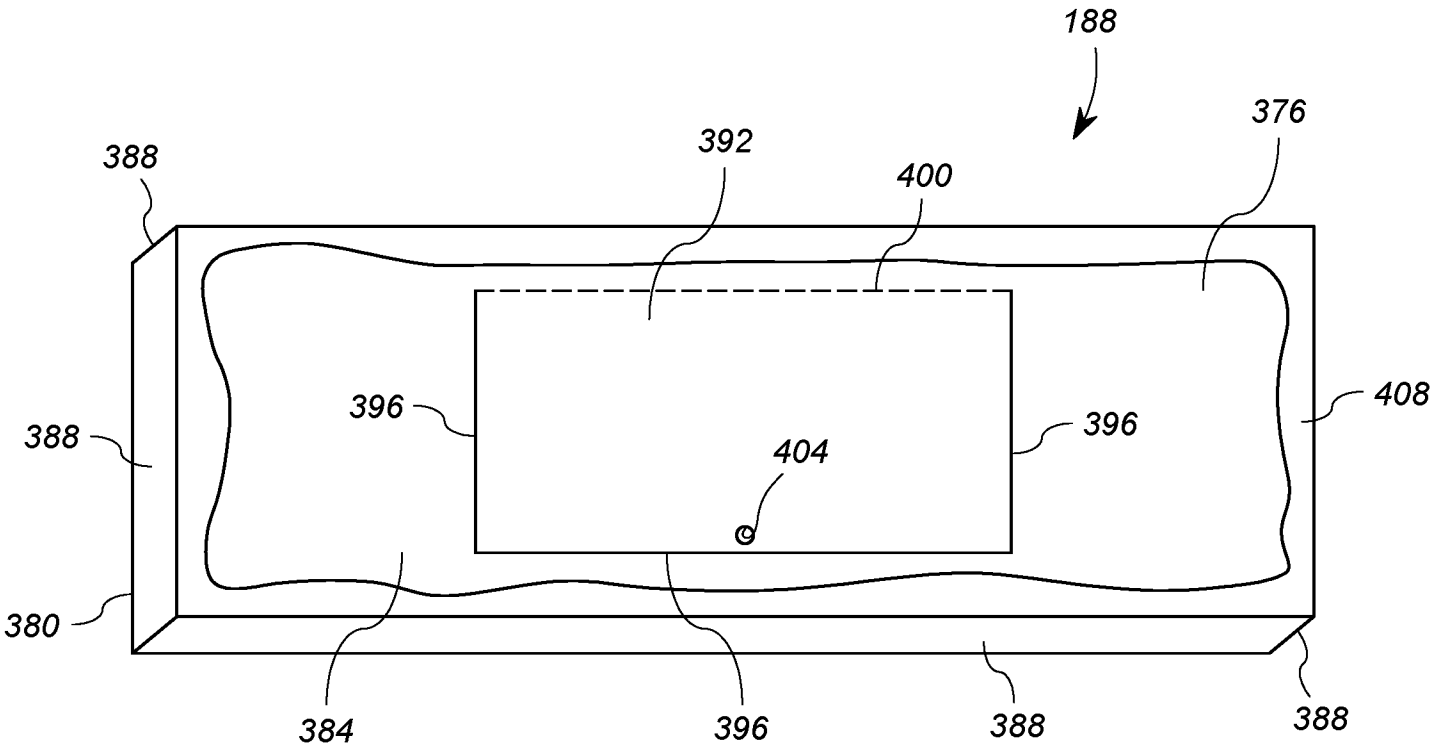
FIG. 15 depicts a bottom perspective view of the insert of the casket assembly of FIGS. 1A and 1B.

Turning now to FIG. 15, the insert 188, configured to be received within the casket assembly 100 on top of the base 104 and between the first and second side panels 108, 112, is shown in more detail. The insert 188 includes a main body 376 having a top 380 and a bottom 384. The bottom 384 of the main body 376 of the insert 188 is arranged to face toward the base 104 when the insert 188 is received within the casket assembly 100. The insert 188 also includes side walls 388 which project orthogonally from the main body 376 in the direction of the top 380. When the insert 188 is received within the casket assembly 100, the side walls 388 are arranged adjacent to the inwardly facing surfaces 144, 152 of the first and second side panels 108, 112, respectively. Accordingly, when the casket assembly 100 is assembled as shown in FIG. 1A, the inwardly facing surfaces 144, 152 of the first and second side panels 108, 112 are adjacent to and facing the side walls 338 of the insert 188, and the outwardly facing surfaces 284, 288 of the first and second side panels 108, 112 are adjacent to and facing the first side 192, second side 196, head end 200, and foot end 204 of the base 104.

With continued reference to FIG. 15, the insert 188 also includes an access flap 392 formed in the main body 376. The access flap 392 is substantially rectangularly shaped and consists of three cut sides 396 and one fold side 400 (shown in dashed lines). The three cut sides 396 are cut through the top 380 and the bottom 384 of the main body 476. The fold side 400 is not cut and thus enables the access flap 392 to fold relative to the main body 376 at the fold side 400. In at least one embodiment, the access flap 392 includes a finger hole 404 sized and configured substantially similarly to the finger hole 360 in the main body 348 of the head lid portion 116. The finger hole 404 enables a finger inserted through the finger hole 404 to grip and pull the access flap 392 to open the access flap 392.

In at least one embodiment, the insert 188 also includes a fabric covering 408 fastened to the bottom 384 of the insert 188 so as to cover the side walls 388 and the top 380 of the insert 188. The fabric covering 408 is fastened to the bottom 384 of the insert 188 by, for example, gluing. In alternative embodiments, the fabric covering 384 is fastened to the bottom 384 around the access flap 392 by stapling or any other means which securely fastens the fabric covering 408 to the insert 188. Fastening the fabric covering 408 to the bottom 384 in this manner forms a pocket between the fabric covering 408 and the top 380 of the main body 376 of the insert 188, the pocket being accessible from the bottom 384 of the main body 376 via the access flap 392. In at least one embodiment, a pillow or a mattress (not shown) is inserted between the top 380 of the main body 376 and the fabric covering 408 via the access flap 392.

To assemble the casket assembly 100, as shown in FIG. 1A, the first and second side panels 108, 112 are first folded into the folded configuration, and then arranged partially within the base 104 such that the outwardly facing surfaces 284, 288 (shown in FIG. 8) of the first and second side panels 108, 112 are arranged along the first side 192, the second side 196, the head end 200, and the foot end 204 of the base 104. More specifically, as shown in FIG. 1B, the main body portion 236 of the second side panel 112 is arranged along the first side 192 of the base 104 such that the left end portion 240 of the second side panel 112 is arranged along a portion of the head end 200 of the base 104 and the right end portion 244 of the second side panel 112 is arranged along a portion of the foot end 204 of the base 104. Conversely, the main body portion 236 of the first side panel 108 is arranged along the second side 196 of the base 104 such that the left end portion 240 of the first side panel 112 is arranged along a portion of the head end 200 of the base 104 and the right end portion 244 of the first side panel 108 is arranged along a portion of the foot end 204 of the base 104. Accordingly, the head end 200 of the base 104 and the left end portions 240 of the first and second side panels 108, 112 make up the head end 132 (shown in FIG. 1A) of the casket assembly 100, the foot end 204 of the base 104 and the right end portions 244 of the first and second side panels 108, 112 make up the foot end 136 (shown in FIG. 1A) of the casket assembly 100, the first side 192 of the base 104 and the main body portion 236 of the second side panel 112 make up the first side 124 (shown in FIG. 1A) of the casket assembly 100, and the second side 196 of the base 104 and the main body portion 236 of the first side panel 108 make up the second side 128 (shown in FIG. 1A) of the casket assembly 100.

In one embodiment, the first and second side panels 108, 112 are fastened to the base 104 in this arrangement. In another embodiment, the first and second side panels 108, 112 are not fastened to the base 104 but are held in this arrangement relative to the base by the insertion of the insert 188 (shown in FIGS. 2A and 2B) between the first and second side panels 108, 112. In one embodiment, a pillow or mattress (not shown) is inserted through the access flap 392 (shown in FIG. 15) into the pocket between the fabric covering 408 and the top 380 of the main body 376 of the insert 188.

Once the insert 188 has been received within the casket assembly 100, the head lid portion 116 and the foot lid portion 120 are received between the first and second side panels 108, 112 to form the lid 114 on the casket assembly 100. First, the foot lid portion 120 (shown in FIG. 11, is removably coupled to the first and second side panels 108, 112. The foot tab 168 of the foot lid portion 120, which is folded downwardly relative to the main body 326 of the foot lid portion 120, is inserted into the foot end gaps 322 (shown in FIG. 2B) between the foot end 314 of each of the supports 306 of the first and second rails 140, 148 and the right end portions 244 of the first and second side panels 108, 112 arranged at the foot end 136 of the casket assembly 100. The main body 326 of the foot lid portion 120 is then rested on the supports 306 of the first and second rails 140, 148 inside the casket assembly 100. The latch elements 172 projecting downwardly from the bottom surface 334 of the foot lid portion 120 are coupled with the mating latch elements 164 on the first and second rails 140, 148 to lock the foot lid portion 120 onto the first and second side panels 108, 112.

Next, the head lid portion 116 (shown in FIG. 12) is removably coupled to the first and second side panels 108, 112. The central tab 176 of the head lid portion 116 is inserted between the bottom surface 334 of the foot lid portion 120 and the supports 306 of the first and second rails 140, 148. The main body 348 of the head lid portion 116 is then rested on the supports 306 of the first and second rails 140, 148 inside the casket assembly 100. The head tab 180 of the head lid portion 116, which is folded downwardly relative to the bottom surface 356 of the head lid portion 116, is inserted into the head end gaps 318 (shown in FIG. 2B) between the head ends 310 of each of the supports 306 of the first and second rails 140, 148 and the left end portions 240 of the first and second side panels 108, 112 arranged at the head end 132 of the casket assembly 100.

To remove the head lid portion 116 from the casket assembly 100, a finger is inserted into the finger hole 360 of the head lid portion 116 and the head lid portion 116 is lifted off of the first and second rails 140, 148 and slid out from underneath the bottom surface 334 of the foot lid portion 120. To remove the foot lid portion 120 from the casket assembly 100, the latch elements 172 and mating latch elements 164 are manually decoupled and the foot lid portion 120 is lifted off of the first and second rails 140, 148.

Figure 16:
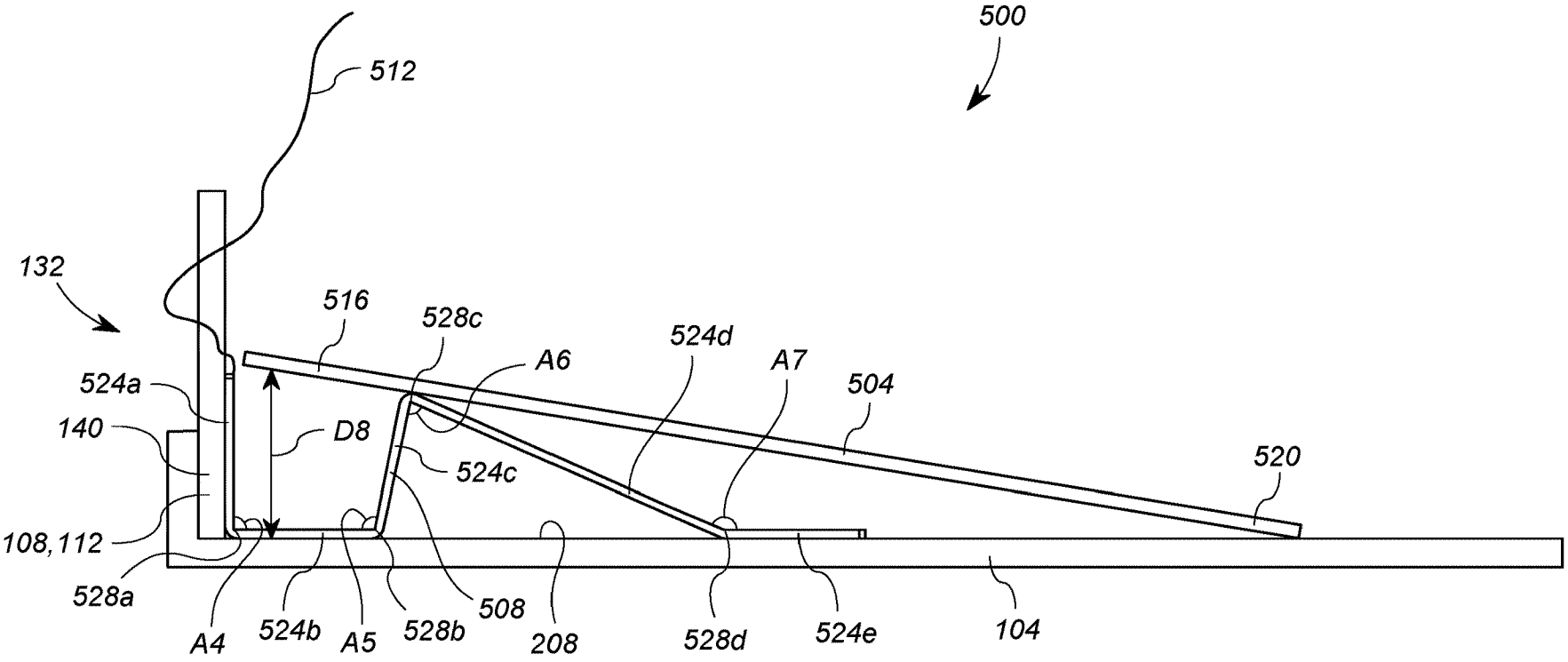
FIG. 16 depicts a side, cross-sectional view of a lift apparatus to be used in the casket assembly of FIGS. 1A and 1B in a first position.

In at least one embodiment, the casket assembly 100 further includes a lift apparatus 500, shown in FIG. 16. The lift apparatus 500 is configured to be inserted between the base 104 and the insert 188 (shown in FIG. 15) at the head end 132 of the casket assembly 100 to adjust an angle of the insert 188 at the head end 132 of the casket assembly 100 (shown in FIGS. 1A and 1B). The lift apparatus 500 includes a platform 504, a panel 508, and an elongated element 512. In at least some embodiments including the lift apparatus 500, the insert 188 includes an opening (not shown) configured to pass the elongated element 512 of the lift apparatus 500 therethrough. The elongated element 512 is preferably a flexible member that may be readily tucked inside the casket 100 when not in use. The elongated element 512 may suitable be a string, cable, or wire, or a ribbon made of polymer or other flexible material.

The platform 504 in this embodiment is a rigid, flat member formed of corrugated paper, particle board, plywood, or some other rigid material. The platform 504 is configured to directly contact and support the bottom side 384 of the insert 188 near the head end 132 of the casket assembly 100. In general, the lift arrangement 500 is configured to support the head end of the insert 188 (not shown in FIG. 16 or 17) in at least two vertical positions, a raised position (corresponding to FIG. 16) and a lowered position (corresponding to FIG. 17). When the insert 188 is disposed on the platform 504 with a deceased, the raised position provides for better viewing, and the lowered position allows for the lid 114 to be placed over the deceased in the insert 188 on the on the casket base 104.

The platform 504 includes a head end 516, to be arranged nearer to the head end 132 of the casket assembly 100, and a foot end 520, to be arranged farther from the head end 132 of the casket assembly 100. The platform 504 is supported by the panel 508, which is coupled to the base 104 of the casket assembly 100. The platform 504 is configured to have a structural strength sufficient to support at least the upper torso of a human deceased in both the raised and lowered position. By adjusting a distance between the head end 516 of the platform 504 and the base 104, the panel 508 adjusts the angle of the insert 188 at the head end 132, and thus the height of the head of the deceased, not shown, within the casket assembly 100. It will be appreciated, however, that in other embodiments the deceased may be disposed directly on the platform 504 instead of the insert 188, or disposed on a structure other than the insert 188 that rests on or is otherwise supported by the platform 504.

Figure 17:
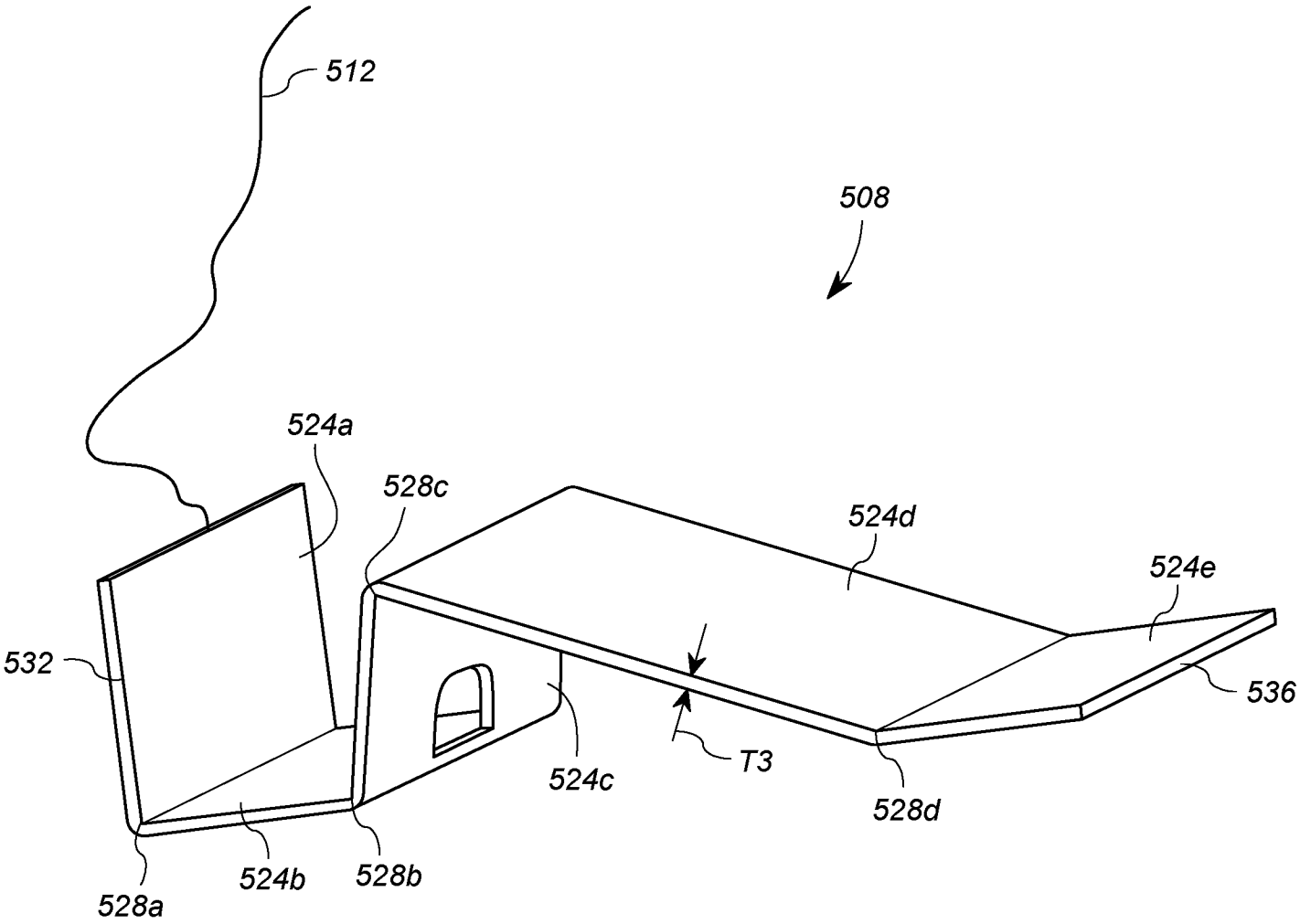
FIG. 17 depicts a top perspective view of a panel of the lift apparatus of FIG. 16.

Turning now to FIG. 17, the panel 508 includes a plurality of panel segments 524 and a plurality of hinges 528. Each of the panel segments 524 is a flat, rigid member separated from one another by a hinge 528. The panel segments 524 include a first segment 524*a*, a second segment 524*b*, a third segment 524*c*, a fourth segment 524*d*, and a fifth segment 524*e* separated from one another by a first hinge 528*a*, a second hinge 528*b*, a third hinge 528*c*, and a fourth hinge 528*d*, respectively. The panel 508 also includes a head portion 532 arranged to rest against the left end portions 240 of the first and second side panels 108, 112 at the head end 132 of the casket assembly 100. The elongated element 512 is coupled to the head portion 532 of the panel 508 and is arranged so as to pass through the opening (not shown) in the platform 504. The panel 508 also includes a bottom portion 536, configured to be fixedly coupled to the bottom 208 of the base 104 (shown in FIG. 16). The head portion 532 is the first segment 524*a* and the bottom portion 536 is the fifth segment 524*e* of the panel segments 524. The second, third, and fourth segments 524*b*, 524*c*, 524*d* are arranged, in that order, from the first segment 524*a* to the fifth segment 524*e*.

Figure 18:
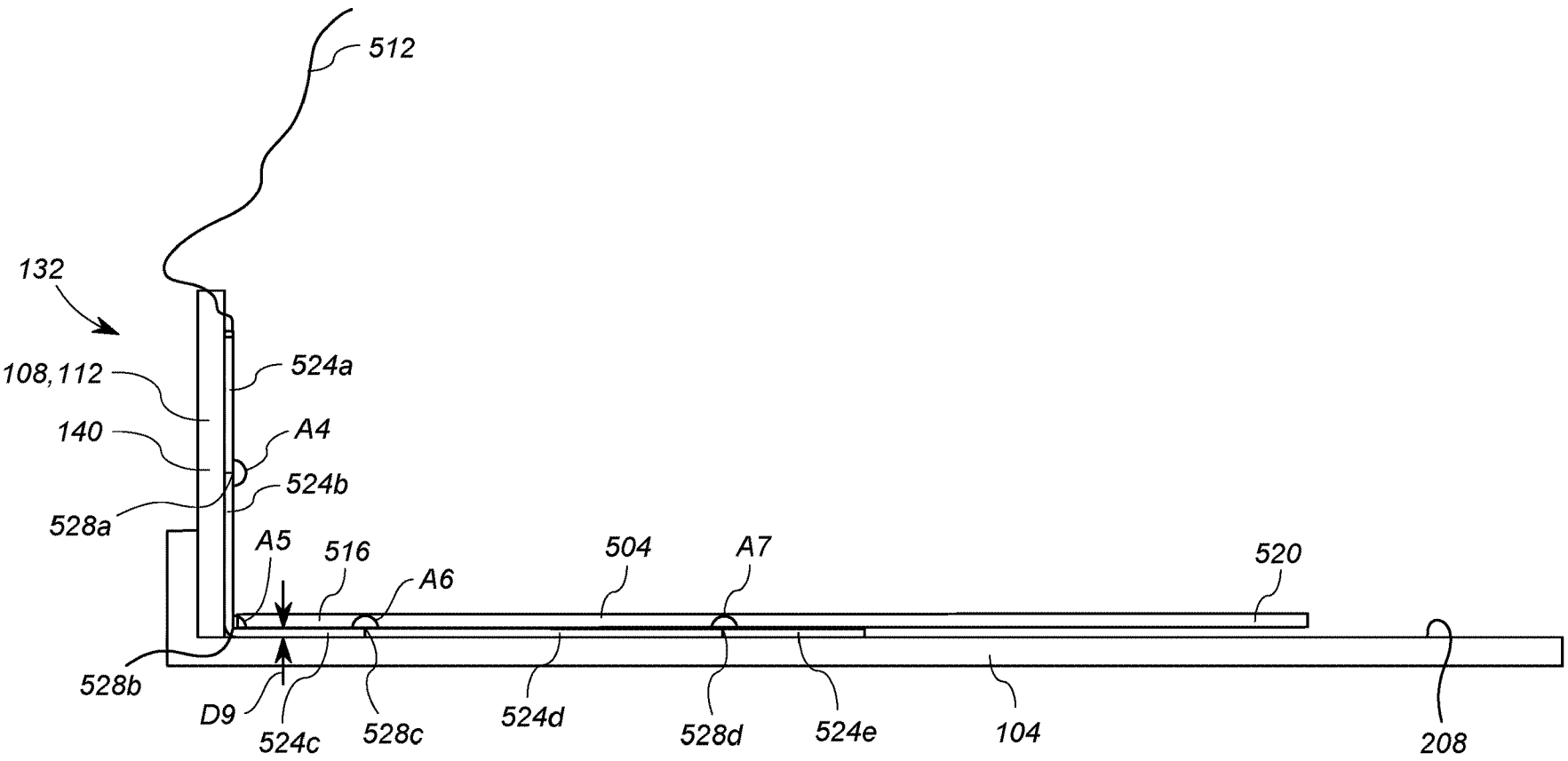
FIG. 18 depicts a side, cross-sectional view of the lift apparatus of FIG. 16 in a second position.

The panel 508 is foldable at the hinges 528 between a first configuration, shown in FIG. 16, wherein the head end 516 of the platform 504 is spaced a distance D8 from the base 104, and a second configuration, shown in FIG. 18, wherein the head end 516 of the platform 504 is spaced a distance D9, smaller than the distance D8, from the base 104. The distance D8 can be, for example, between 3 and 4 inches. In a particular embodiment, the distance D8 is approximately 3.5 inches. The distance D9 can be, for example, between 0.05 and 0.75 inches. In a particular embodiment, the distance D9 is approximately 0.25 inches.

Turning to FIG. 16, in the first configuration, the first segment 524*a* is abutting the left end portions 240 of the first and second side panels 108, 112 at the head end 132 of the casket assembly 100. The first hinge 528*a* is positioned in a corner where the left end portions 240 of the first and second side panels 108, 112 meet the bottom 208 of the base 104. The first hinge 528*a* is folded at an angle A4 between the first segment 524*a* the second segment 524*b*, wherein the angle A4 is approximately 90 degrees. In other words, the second segment 524*b* is substantially perpendicular to the first segment 524*a*. The second segment 524*b* is arranged on the bottom 208 of the base 104 and is substantially parallel and co-planar with the fifth segment 524*e*. The second hinge 528*b* is folded at an angle A5 between the second segment 524*b* and the third segment 524*c*, wherein the angle A5 is between approximately 90 and approximately 180 degrees. The third segment 524*c* projects upwardly from the bottom 208 of the base 104 within the casket assembly 100. The third hinge 528*c* is folded at an angle A6 between the third segment 524*c* and the fourth segment 524*d*, wherein the angle A6 is between approximately 180 and approximately 270 degrees. The fourth segment 524*d* projects downwardly toward the bottom 208 of the base 104 from the third hinge 528*c*. The fourth hinge 528*d* is folded at an angle A7 between the fourth segment 524*d* and the fifth segment 524*e*, wherein the angle A7 is between approximately 90 and approximately 180 degrees. In the first configuration, the fourth segment 524*d* and the third hinge 528*c* support the head end 516 of the platform 504 at the distance D8.

To reconfigure the panel 508 from the first configuration to the second configuration, the elongated element 512 is pulled upwardly, away from the bottom 208 of the base 104. Because the elongated element 512 is coupled to the head portion 532 of the panel 508, pulling the elongated element 512 upwardly slides the head portion 532 of the panel 508 upwardly along the left end portions 240 of the first and second side panels 108, 112. Because the bottom portion 536 of the panel 508 is coupled to the bottom 208 of the base 104, sliding the head portion 532 of the panel 508 upwardly pulls the panel segments 524 toward the head end 132 of the casket assembly 100, changing the angles A4, A5, A6, A7 of the hinges 528 between the panel segments 524 and changing the positions of the panel segments 524. The weight of the platform 504, including the weight of the insert 188 (shown in FIG. 15) and the deceased which are supported by the platform 504, also apply downward force to the panel segments 524, contributing to the reconfiguration of the panel 508.

Turning to FIG. 18, in the second configuration, the first segment 524*a* is abutting the left end portions 240 of the first and second side panels 108, 112 at the head end 132 of the casket assembly 100. The first hinge 528*a* is also abutting the left end portions 240 of the first and second side panels 108, 112. The angle A4 of the first hinge 528*a* is folded at approximately 180 degrees. Accordingly, the second segment 524*b* is also arranged abutting the left end portions 240 of the first and second side panels 108, 112. The second segment 524*b* is, thus, parallel and co-planar with the first segment 524*a* and is substantially perpendicular to the fifth segment 524*e*. The angle A5 of the second hinge 528*b* is folded at approximately 90 such that the third segment 524*c* is arranged on the bottom 208 of the base 104 and is substantially parallel and co-planar with the fifth segment 524*e*. Thus, the third segment 524*c* is substantially perpendicular to the second segment 524*b* and to the first segment 524*a*. The angle A6 of the third hinge 528*c* is folded at approximately 180 degrees such that the fourth segment 524*d* is also arranged on the bottom 208 of the base 104 and is substantially parallel and co-planar with the third segment 524*c* and with the fifth segment 524*e*. Accordingly, the angle A7 of the fourth hinge 528*d* is also folded at approximately 180 degrees. In the second configuration, the third, fourth, and fifth segments 524*c*, 524*d*, 524*e* and the third and fourth hinges 528*c*, 628*d* support the head end 516 of the platform 504 at the distance D9 from the base 104. In other words, the distance D9 is approximately equal to a thickness T3 of the panel 508 (shown in FIG. 17).

Because the panel 508 is moved from the first configuration to the second configuration by pulling the elongated element 512 upwardly, enabling the weight on the platform 504 to force the panel segments 524 downwardly, once the panel 508 has been moved from the first configuration to the second configuration, the panel 508 cannot be returned to the first configuration without removing the weight from the platform 504. In other words, when the lift mechanism 500 is used in the casket assembly 100, the head end 516 of the platform 104 can be lowered from the distance D8 to the distance D9, but cannot lifted from the distance D9 to the distance D8, relative to the bottom 208 of the base 104. Thus, the insert 188 can be lowered, but cannot be lifted, within the base 104.

By way of example, the lift mechanism 500 is shown in use in conjunction with casket assembly 100. However, the lift mechanism 500 is configured to be used in any casket assembly having an insert supported within a base, similar to the insert 188 supported by the base 104.

It will be appreciated that the above-described embodiments are merely illustrative. Those of ordinary skill in the art may readily devise their own modifications that incorporate the principles of various aspects of the present invention and fall within the spirit and scope thereof.

What is claimed is:

1. A method of assembling a casket assembly, comprising:

folding a left end portion of a first side panel toward a main body portion of the first side panel to form a first portion of a head end of the casket assembly;

folding a right end portion of the first side panel toward the main body portion of the first side panel to form a first portion of a foot end of the casket assembly;

folding a left end portion of a second side panel toward a main body portion of the second side panel to form a second portion of the foot end of the casket assembly;

folding a right end portion of the second side panel toward the main body portion of the second side panel to form a second portion of the head end of the casket assembly;

arranging the second portion of the head end adjacent to the first portion of the head end and the second portion of the foot end adjacent to the first portion of the foot end;

arranging the first side panel and the second side panel within a base of the casket assembly; and removably coupling a lid of the casket assembly to the first side panel and the second side panel;

wherein arranging the first and second side panels within the base of the casket assembly forms an inside of the casket assembly within the base and the first and second side panels and forms an outside of the casket assembly that is outside of the base and the first and second side panels.

2. The method of claim 1, wherein:

when the first side panel is arranged within the base of the casket assembly, the main body portion of the first side panel forms a front side of the casket assembly; and when the second side panel is arranged within the base of the casket assembly, the main body portion of the second side panel forms a back side of the casket assembly.

3. The method of claim 1, further comprising:

covering at least a portion of the first side panel with a covering material before folding the left end portion of the first side panel and before folding the right end portion of the first side panel.

4. The method of claim 1, wherein:

removably coupling the lid of the casket assembly to the first side panel and the second side panel includes removably coupling the lid of the casket assembly to the inside of the casket assembly.

5. The method of claim 1, further comprising forming the first side panel by folding over a first blank to form inwardly facing surfaces and outwardly facing surfaces, and forming the second side panel by folding over a second blank to form inwardly facing surfaces and outwardly facing surfaces.

6. The method of claim 1, further comprising:

coupling a first portion of a first connector to the first portion of the head end of the casket assembly;

coupling a first portion of a second connector to the second portion of the foot end of the casket assembly;

inserting a second portion of the first connector between the inwardly facing surfaces of the second side panel at the second portion of the head end of the casket assembly; and inserting a second portion of the second connector between the inwardly facing surfaces of the first side panel at the first portion of the foot end of the casket assembly.

7. The method of claim 1, wherein:

folding the left end portion of the first side panel toward the main body portion of the first side panel includes folding the left end portion at a first side panel left slit such that the first side panel left slit is arranged on the inside of the casket assembly when the first and second side panels are arranged within the base, folding the right end portion of the first side panel toward the main body portion of the first side panel includes folding the right end portion at a first side panel right slit such that the first side panel right slit is arranged on the inside of the casket assembly when the first and second side panels are arranged within the base, folding the left end portion of the second side panel toward the main body portion of the second side panel includes folding the left end portion at a second side panel left slit such that the second side panel left slit is arranged on the inside of the casket assembly when the first and second side panels are arranged within the base, and folding the right end portion of the second side panel toward the main body portion of the second side panel includes folding the right end portion at a second side panel right slit such that the second side panel right slit is arranged on the inside of the casket assembly when the first and second side panels are arranged within the base.

8. The method of claim 1, further comprising:

coupling a first rail to the first side panel, and coupling a second rail to the second side panel.

9. The method of claim 8, wherein:

removably coupling the lid of the casket assembly to the first side panel and the second side panel includes removably coupling the lid to the first rail and the second rail.

10. The method of claim 9, wherein:

the lid of the casket assembly includes a foot lid portion and a head lid portion, and removably coupling the lid of the casket assembly to the first rail and the second rail includes removably coupling the foot lid portion to the first and second rails and removably coupling the head lid portion to the first and second rails.

11. The method of claim 10, wherein:

removably coupling the lid of the casket assembly to the first and second rails includes coupling a first latch element on the foot lid portion into a first mating latch element.

12. The method of claim 10, wherein:

removably coupling the head lid portion to the first and second rails includes inserting a tab portion of the head lid portion between the foot lid portion and the first and second rails.

13. The method of claim 1, further comprising:

forming the first side panel of the casket assembly to have a plurality of handle notches on a first edge of the first side panel, and forming the second side panel of the casket assembly to have a plurality of handle notches on a first edge of the second side panel.

14. The method of claim 13, wherein:

arranging the first side panel within the base of the casket assembly includes arranging the first edge of the first side panel within the base of the casket assembly, and arranging the second side panel within the base of the casket assembly includes arranging the first edge of the second side panel within the base of the casket assembly.

15. The method of claim 14, wherein:

arranging the first edge of the first side panel within the base of the casket assembly includes aligning at least two of the plurality of handle notches on the first side panel with at least two handles formed on a front side of the base, and arranging the first edge of the second side panel within the base of the casket assembly includes aligning at least two of the plurality of handle notches on the second side panel with at least two handles formed on a back side of the base.

16. The method of claim 15, wherein:

aligning the at least two of the plurality of handle notches on the first side panel with the at least two handles formed on the front side of the base includes aligning a handle notch notches nearest to the left end portion of the first side panel with one of the at least two handles formed on the front side of the base, and aligning the at least two of the plurality of handle openings on the second side panel with the at least two handles formed on the back side of the base includes aligning a handle notch nearest to the right end portion of the second panel with one of the at least two handles formed on the back side of the base.

17. The method of claim 1, further comprising:

inserting a tray into the base of the casket assembly between the first side panel and the second side panel before removably coupling the lid of the casket assembly to the first and second side panels.

* * * * *